US009748059B2

(12) United States Patent
Cernat et al.

(10) Patent No.: US 9,748,059 B2
(45) Date of Patent: Aug. 29, 2017

(54) SWITCHING DEVICE ARRANGEMENT

(71) Applicant: SIEMENS AKTIENGESELLSCHAFT, Munich (DE)

(72) Inventors: Radu-Marian Cernat, Berlin (DE); Martin Krehnke, Berlin (DE); Volker Lehmann, Treuenbrietzen (DE); Friedrich Loebner, Berlin (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/761,703

(22) PCT Filed: Jan. 7, 2014

(86) PCT No.: PCT/EP2014/050132

§ 371 (c)(1),
(2) Date: Jul. 17, 2015

(87) PCT Pub. No.: WO2014/114482

PCT Pub. Date: Jul. 31, 2014

(65) Prior Publication Data

US 2015/0371796 A1 Dec. 24, 2015

(30) Foreign Application Priority Data

Jan. 22, 2013 (DE) ..... 10 2013 200 918

(51) Int. Cl.
*H01H 33/02* (2006.01)
*H01H 33/12* (2006.01)
(Continued)

(52) U.S. Cl.
CPC ..... *H01H 33/025* (2013.01); *H01H 33/06* (2013.01); *H01H 33/123* (2013.01);
(Continued)

(58) Field of Classification Search
CPC ..... H01H 33/025; H01H 33/06; H01H 33/42; H01H 33/123; H01H 33/245; H01H 33/70; H01H 33/7023; H01H 2221/016
(Continued)

(56) References Cited

U.S. PATENT DOCUMENTS 5,578,806 A 11/1996 Hofbauer et al.
6,015,960 A 1/2000 Girodet et al.
(Continued)

FOREIGN PATENT DOCUMENTS

CN 1223449 A 7/1999
CN 1310460 A 8/2001
(Continued)

*Primary Examiner* — Renee Luebke
*Assistant Examiner* — William Bolton

(57) ABSTRACT

A switching device arrangement has a first contact set and a second contact set. The first contact set includes a first electric arc contact element and a first nominal current contact element. The first nominal current contact element can be moved relative to the first electric arc contact element. A first transmission is introduced in a kinematic chain in order to generate a relative movement of the first nominal current contact element and the first electric arc contact element. The first transmission is operationally connected between a stationary counter bearing and the first electric arc contact piece.

19 Claims, 16 Drawing Sheets

(51) Int. Cl.
*H01H 33/24* (2006.01)
*H01H 33/06* (2006.01)
*H01H 33/42* (2006.01)

(52) U.S. Cl.
CPC ..... *H01H 33/245* (2013.01); *H01H 33/42* (2013.01); *H01H 2033/028* (2013.01); *H01H 2221/016* (2013.01); *H01H 2221/024* (2013.01)

(58) Field of Classification Search
USPC ..... 218/146, 120, 57, 43, 48, 59, 61, 63, 78
See application file for complete search history.

(56) References Cited

U.S. PATENT DOCUMENTS

| | | | | |
|---|---|---|---|---|
| 6,049,050 | A * | 4/2000 | David | H01H 3/36 218/154 |
| 6,177,643 | B1 * | 1/2001 | Marin | H01H 33/245 218/45 |
| 6,271,494 | B1 | 8/2001 | Dienemann et al. | |
| 6,429,394 | B2 | 8/2002 | Hunger et al. | |
| 6,462,295 | B1 | 10/2002 | Knobloch et al. | |
| 7,642,480 | B2 * | 1/2010 | Ozil | H01H 33/904 218/14 |
| 8,013,268 | B2 | 9/2011 | Ozil et al. | |
| 8,304,677 | B2 | 11/2012 | Yoon | |
| 2001/0025882 | A1 | 10/2001 | Coulier et al. | |
| 2009/0095716 | A1 | 4/2009 | Einschenk | |

FOREIGN PATENT DOCUMENTS

| | | | |
|---|---|---|---|
| CN | 1357901 | A | 7/2002 |
| DE | 19622460 | A1 | 11/1997 |
| DE | 19741660 | A1 | 3/1999 |
| DE | 19902835 | C2 | 12/2001 |
| DE | 60120885 | T2 | 1/2007 |
| EP | 0696040 | B1 | 6/1998 |
| EP | 1124243 | A2 | 8/2001 |
| EP | 2343720 | A1 | 7/2011 |
| KR | 20070008041 | A | 1/2007 |
| RU | 2256975 | C2 | 7/2005 |
| WO | 9832142 | A1 | 7/1998 |

* cited by examiner

SWITCHING DEVICE ARRANGEMENT

BACKGROUND OF THE INVENTION

Field of the Invention

The invention relates to a switching device arrangement comprising a first contact set, which can be moved relative to a second contact set in order to produce a clearance between contacts, wherein the first contact set has a first arcing contact piece and a first nominal current contact piece, which can be moved relative to one another, and comprising a kinematic chain connected to the first nominal current contact piece in order to impress a movement onto the first nominal current contact piece, wherein a relative movement is effected between the first nominal current contact piece and first arcing contact piece via a first gearing.

A switching device arrangement of this type is known for example from the Korean patent application KR 10-2007-0008041. There, a switching device arrangement is described which has a first and a second contact set. The two contact sets can be moved relative to one another in order to form a clearance between contacts. The first contact set is equipped here with a first arcing contact piece and with a first nominal current contact piece, wherein the first nominal current contact piece and the first arcing contact piece can be moved relative to one another. With the known switching device arrangement the use of a kinematic chain is provided in order to impress a movement onto the first nominal current contact piece. A relative movement is effected between the first nominal current contact piece and the second nominal current contact piece by means of a gearing. In that case a fork lever is used, by means of which a movement reversal is enforced. In that case the fork lever can be brought into engagement with a drive rod of the kinematic chain. Driving pins are arranged for this purpose on the drive rod and enter a fork opening or contact a fork end as necessary. A disadvantage of this construction is that the fork lever is not located permanently in a secured position. Rather, during the course of a switching movement, states occur in which the fork lever is freely pivotable, detached from any driving pins of the drive rod. Here, there is the risk that, for example as a result of vibrations at the first contact set of the known switching device arrangement, an unintentional movement of the first arcing contact piece will be initiated. This may lead to malfunctions at the switching device arrangement.

BRIEF SUMMARY OF THE INVENTION

The object of the invention is therefore to specify a switching device arrangement that enables a secure relative movement of a contact set.

The object is achieved in accordance with the invention in the case of a switching device arrangement of the type discussed in the introduction in that the first gearing constitutes an operative connection between a stationary counter bearing and the first arcing contact piece.

A switching device arrangement comprising a first contact set and a second contact set is advantageously equipped at least at one contact set, in particular at both contact sets, with an arcing contact piece and a nominal current contact piece. Here, the first contact set may have a first arcing contact piece and a first nominal current contact piece and the second contact set may have a second arcing contact piece and a second nominal current contact piece. The first and second arcing contact pieces or first and second nominal current contact pieces are shaped here in a manner complementary to one another, such that they can be galvanically contacted and a continuous current path can be produced by means of the switching device arrangement. Here, the contact sets are arranged so as to be movable relative to one another, i.e. at least one of the contact sets, in particular both contact sets, can be positioned movably. It is thus possible via the switching device arrangement to produce an electrical current path as necessary or to interrupt this current path as necessary. In particular in embodiments of the switching device arrangement as a circuit breaker switching device arrangement, it is thus made possible for example to repeatedly securely interrupt a short-circuit current, by way of example even in the event of a fault. Due to the use of arcing contact pieces and nominal current contact pieces, it is possible to optimize the current-carrying capacity of the nominal current contact pieces so as to be able to convey currents at low impedances with low loss. The arcing contact pieces can be optimized in terms of their resistance to thermal influences of switching arcs, in particular switch-off arcs. Accordingly, in the event of a switch-on operation, the arcing contact pieces are firstly to be contacted in a leading manner, whereupon the nominal current contact pieces are then contacted. Switch-on arcs thus occur preferably at the arcing contact pieces. By contrast, in the event of a switch-off operation, the nominal current contact pieces are opened or separated first, whereby a current to be switched off commutates from the nominal current contact current path to the arcing contact current path and a switch-off arc following a separation of the arcing contact pieces is guided preferably between the arcing contact pieces. In order to enable a commutation, the first nominal current contact piece and the first arcing contact piece and/or the second nominal current contact piece and the second arcing contact piece should in each case permanently convey the same electrical potential and for this purposes should be electrically conductively connected accordingly.

Here, it is particularly advantageous when the contact sets are mounted axially displaceably, such that a relative movement in the form of an axial movement of at least one of the contact sets is produced. The respective nominal current contact pieces and arcing contact pieces advantageously may preferably be arranged coaxially with one another, wherein the contact sets are arranged facing one another at end faces. By way of example, it is thus possible to form one arcing contact piece in a pin-like manner and to form an opposite arcing contact piece in a socket-like manner, such that the arcing contact pieces can be contacted or separated from one another by a relative linear movement. Analogously, the nominal current contact pieces may also be shaped in a complementary manner and may be arranged opposite one another at end faces. Here, the nominal current contact pieces and the arcing contact pieces may be substantially rotationally symmetrical and may each be arranged coaxially with a displacement axis. Here, in accordance with an advantageous variant, an arcing contact piece of a contact set is surrounded on the outer circumferential side by a nominal current contact piece, such that a contact set is formed substantially rotationally symmetrically and has a compact and in addition dielectrically favorable rounded shaping.

In addition, a relative movement between a nominal current contact piece and an arcing contact piece may be provided at the first contact set in order to increase the contact separation speed or in order to control the switching sequence of arcing contact pieces and nominal current contact pieces. By way of example it is thus possible to provide a leading contacting of the arcing contact pieces during a switch-on operation and to generate a lagging separation of the arcing contact pieces during a switch-off operation. By way of example, a relative movement between the nominal current contact piece and arcing contact piece of a contact set may be performed in such a way that the nominal current contact piece is moved with a first movement profile, whereas the second arcing contact piece is moved with a second movement profile. The two movement profiles advantageously can be superimposed in such a way that the arcing contact piece is moved at least in portions at a quicker speed than the nominal current contact piece. By way of example it is thus possible that, initiated by a movement of the nominal current contact piece, the first arcing contact piece is additionally moved and an increased contacting or contact separation speed of the arcing contact piece compared with the movement of the first nominal current contact piece is enforced. By way of example, the first arcing contact piece may also be moved in the event of a movement of the first nominal current contact piece. In addition, a movement can be impressed onto the first arcing contact piece, such that, in addition to the joint movements of first nominal current contact piece and first arcing contact piece, a resultant movement occurs at the first arcing contact piece. The first nominal current contact piece and the second arcing contact piece can be moved, in a manner deviating from one another, relative to a stationary counter bearing, wherein a movement of the first nominal current contact piece is part of the movement of the first arcing contact piece. On the one hand, a leading and lagging of the arcing contact pieces in the above-mentioned manner can thus be generated. On the other hand, a rapid dielectric reinforcement of the clearance between contacts can be produced, in particular in the event of a switch-off operation. By way of example, the first arcing contact piece in the event of a switch-off operation can be returned quickly into a field shadow of the first nominal current contact piece by a superimposition of the movements of arcing contact piece and nominal current contact piece. In the event of a switch-on operation, a quick exit of the first arcing contact piece from the field shadow of the first nominal current contact piece can also be attained. The transitions from a separated state into a switch-on state and vice versa are thus to be performed within a short period of time, such that undesirable field strength superelevations are quickly neutralized and therefore the risk of an uncontrolled development of signs of discharge at the switching device arrangement is reduced.

As a result of the provision of a stationary counter bearing for the first gearing, a base is created on the switching device arrangement, the further movable parts being movable relative to said base. Accordingly, a reference point can be created at this base, via which reference point an activation of the first gearing is controlled. Due to a stationary positioning of the counter bearing, a fixed reference variable is provided at any moment of a switching movement, in relation to which fixed reference variable the first arcing contact piece can be fixed, for example. A movement proceeding from the first arcing contact piece cannot lead to a movement at the first gearing, since this is inhibited. Any detachment or departure, turning, etc. of the first gearing from the stationary counter bearing is prevented. Accordingly, a flow of force is provided between the stationary counter bearing and the first arcing contact piece, which flow of force always unambiguously defined the position of the arcing contact piece. The stationary counter bearing impedes a return of the first gearing. By way of example, the arcing contact piece can be fixed relative to the counter bearing and relative to the nominal current contact piece in each case in a defined position depending on the progress of a switching movement. Irrespective of a switching operation or a movement of the nominal current contact piece, the first gearing can be secured via the counter bearing, such that a self-locking drive of the arcing contact piece is provided. In particular, an additional movement of the first arcing contact piece can be effected depending on the progress of a movement of the first nominal current contact piece. Here, the stationary counter bearing is able to control the ratio of the relative movements of nominal current contact piece and first arcing contact piece. Both the first arcing contact piece and the first nominal current contact piece are mounted movably relative to the stationary counter bearing. The stationary counter bearing forms a stop in order to exert an additional force effect onto the first arcing contact piece starting from a movement of the first nominal current contact piece, and to enforce a movement of the first arcing contact piece relative to the second nominal current contact piece. The stationary counter bearing forms a stop for a movable part of the first gearing. A counter force can be generated at the counter bearing in order to generate a movement at the first gearing.

An operative connection between the stationary counter bearing and the first arcing contact piece makes it possible to utilize a movement of the first nominal current contact piece as an initiating movement for a movement of the first arcing contact piece. Drive energy for generating the relative movement between the first nominal current contact piece and first arcing contact piece at the first contact set is decoupled from the movement of the first nominal current contact piece. The stationary counter bearing generates a counter force for a first gearing movable relative to said counter bearing. In order to form an operative connection between the first gearing and the stationary counter bearing, a gearing element can interact with the stationary counter bearing. The gearing element may be attached movably to the stationary counter bearing. An operative connection for transmitting forces between a gearing element and the stationary counter bearing may be provided permanently or also temporarily during a switching movement.

Furthermore, the stationary counter bearing may advantageously control the transmission behavior of the first gearing.

The stationary counter bearing is part of a base, relative to which movable parts of the first contact set can be moved. The stationary counter bearing can be formed by way of example as a stop, as a cam, as a pin, as a slotted guide, as a groove, etc. The stationary counter bearing serves to initiate a movement depending on a relative movement between the first nominal current contact piece and the stationary counter bearing. The transmission behavior of the first gearing can be defined and controlled by means of a stationary counter bearing. By way of example, it is thus possible to also define a ratio of the movement of the movable parts (for example first arcing contact piece and first nominal current contact piece) to one another by an adjustment/special shaping of the stationary counter bearing. By way of example, a gearing element of the first gearing can be forced into a certain movement path via the counter bearing depending on the mounting of this gearing element and depending on the relative movement of the mounting of the gearing element, or a driving force within the first gearing can be built up by an interaction with the stationary counter bearing, such that, besides a movement of the first nominal current contact piece, a movement of the first arcing contact piece is also performed and is performed both relative to the first nominal current contact piece and relative to the stationary counter bearing. The counter bearing can be used particularly advantageously to superimpose the movements of the first nominal current contact piece and of the first arcing contact piece depending on the progress of a movement of the first nominal current contact piece. The first arcing contact piece may have an increased speed compared with the first nominal current contact piece in relation to the base carrying the stationary counter bearing.

Furthermore, the first gearing may advantageously be mounted on the first contact set, in particular on the first nominal current contact piece.

In the event of a movement of the first contact set, a mounting of the gearing on the first contact set makes it possible to also move the gearing or the bearing of the gearing jointly with the first contact set. The first gearing is thus preferably mounted in a stationary manner on the first contact set. In particular, the first gearing can be mounted in a stationary manner on the first nominal current contact piece of the first contact set. By way of example, a shaft may be mounted rotatably on the first contact set, or rather on the first nominal current contact piece. It is thus possible, by a movement of the first nominal current contact piece relative to the stationary counter bearing, to introduce a driving force into the first gearing. The first contact set, similarly to the first nominal current contact piece, may be constructed here in a number of parts, such that the gearing bearing can also be connected indirectly to the first nominal current contact piece/the first contact set. At least one connection at a fixed angle should advantageously be provided between the bearing point(s) of the first gearing and the first nominal current contact piece/the first contact set.

The counter bearing thus forms a reference point in order to use the movement of the first nominal current contact piece and to introduce this movement into the first arcing contact piece with use of the transmission of the first gearing and thus enforce a movement of the first arcing contact piece, which is preferably produced from an addition of the movement impressed by the first gearing onto the first arcing contact piece and the movement performed by the first nominal current contact piece.

In accordance with a further advantageous embodiment the first nominal current contact piece is mounted movably in relation to the stationary counter bearing.

The first nominal current contact piece should be mounted movably in relation to the stationary counter bearing, such that a relative movement can additionally be performed between the stationary counter bearing and first arcing contact piece. Similarly to the first nominal current contact piece, which is likewise arranged movably in relation to the stationary counter bearing, the stationary counter bearing can thus be used as a deflection point or as a reference variable for generating an additional movement at the first arcing contact piece. By way of example, the first nominal current contact piece can be mounted movably in relation to a base, which comprises the stationary counter bearing. By way of example, the first nominal current contact piece may be positioned axially displaceably. Accordingly, the first arcing contact piece can also be mounted axially displaceably, wherein the displacement axes are preferably arranged congruently or in parallel. Both the first nominal current contact piece and the first arcing contact piece of the first contact set are thus preferably movable in relation to the stationary counter bearing. By means of a guidance of counter contact piece and arcing contact piece performed relative to the stationary counter bearing, both the first nominal current contact piece and the second arcing contact piece, as a movement progresses, can be fixed in each of their positions passed through during a switch-on or switch-off operation. The first gearing defines the relative position of the first arcing contact piece and second nominal current contact piece depending on the position of the first nominal current contact piece. Here, the relative position is defined additionally relative to the base by the operative connection of the first gearing to the stationary bearing point. Accordingly, the positions of the first nominal current contact piece and first arcing contact piece relative to one another and in each case relative to the stationary bearing point are fixed.

It may be advantageous for a control element of the first gearing to be guided on the stationary counter bearing.

A control element of the first gearing may be operatively connected by way of example to the stationary counter bearing. Here, the control element may be formed in one or more parts. By way of example, a forced bond can be enforced between the stationary counter bearing and the movable first arcing contact piece or first nominal current contact piece by means of the control element, and a driving force can be introduced into the first arcing contact piece. A mechanical connection is thus created between the first contact set or rather the first arcing contact piece and the first nominal current contact piece, such that the individual movement positions, in particular of the first arcing contact piece, can be secured via the control element. The first gearing inhibits a free movement of the first arcing contact piece. By means of the design of the control element, it is possible also to transmit a movement, impressed for example onto the first nominal current contact piece, into the first gearing mounted on the nominal current contact piece and to create a force effect at the first arcing contact piece relative to a base (the stationary counter bearing). Depending on the embodiment of the guidance of the control element on the first counter contact, a desired transmission of the movement by the first gearing can be attained. By way of example, it is thus possible to drive the first arcing contact piece at different speeds. By way of example, the control element may be embodied in the form of a spur gear unit with corresponding toothing, such that there is a gear reduction of a relative movement of the nominal current contact piece. Where appropriate, a reversal of a direction of movement for example can be provided via the control element, such that movements in opposite directions between the first nominal current contact piece and first arcing contact piece can be initiated, for example. The control element may advantageously cooperate with the stationary counter bearing in such a way that the arcing contact piece is moved with a certain movement profile during the course of a switching movement depending on the progress of a movement of the nominal current contact piece. By way of example, it is thus possible, at the start and at the end of a movement, for example during a switch-on or a switch-off operation, to drive the arcing contact piece initially at a low speed (possibly remaining still relative to the first nominal current contact piece) and to drive it at a high speed during an intermediate phase. The first arcing contact piece is thus driven quickly into an arcing contact piece of complementary shape. At the start and at the end of a movement, a bouncing of the arcing contact pieces and therefore premature wear can be counteracted by way of example by a speed reduction.

Here, the control element may be operatively connected permanently to the stationary counter bearing. The stationary counter bearing may also be engaged merely temporarily with the control element. By way of example, a lasting connection may be present during a switching operation depending on the progress of a switching movement, so that the control element is guided on the stationary counter bearing. However, the control element may also be guided merely temporarily on the counter bearing. By way of example, the control element may be provided for example in the form of a deflection element, which is engaged merely temporarily with the stationary counter bearing, for example only at the start, only at the end, or also only during a central portion of a switching movement. However, a permanent bond between stationary counter bearing and control element may also be provided for example by means of a rotary connection. Even with a permanent connection/guidance of the control element with the counter bearing, a (temporary) interruption of a transmission function (for example by the use of dead time elements) may be provided.

Furthermore, the stationary counter bearing may advantageously be coupled to the first gearing via a slotted glide path.

In order to form an operative connection, the stationary counter bearing and the control element can be connected to one another for example via a slotted guide path that can be traveled through. The slotted glide path may be located for example on the control element. The control element for example may thus have a fork lever. Providing the stationary counter bearing or the first transmission with a slotted guide path makes it possible to provide the operative connection between the first gearing and stationary counter bearing with a variable transmission behavior. A slotted guide path by way of example is a path that is to be traveled through or engaged by a control element of the first gearing. It may also be that the slotted guide path is arranged on a gearing element, in particular a control element of the first gearing, which path in turn is traveled through by the stationary counter bearing. By way of example, the slotted guide path may thus be shaped in the form of a cam disc, a groove, or a thread, etc. the slotted guide path by way of example may effect a stronger or weaker transmission at the first gearing. By way of example, the slotted glide path may have what are known as dead time areas, in which no movement where possible is transmitted from the first gearing to the first arcing contact piece. However, by means of a corresponding shaping and position of the slotted guide path, the transmission of the gearing may also be intensified, or the transmission of the first gearing may be attenuated. It may be particularly advantageous when the slotted guide path has a through-recess, with which a control element of the first gearing engages. By way of example, this control element may touch cheeks delimiting the recess. Alternatively, the slotted guide path may also be formed for example in the manner of a groove, through which a sliding block can be moved, wherein the sliding block should be connected to the first gearing or rather the control element thereof. Equivalently, an alternative positioning of a slotted guide path on a control element may also be provided, which path is traveled through by the counter bearing.

In accordance with a further advantageous embodiment the first gearing may have a pivot element, which is attached pivotably to the first nominal current contact piece.

A pivot element of the first gearing is advantageously attached rotatably to the first nominal current contact piece, such that a pivot point of the pivot element is moved jointly with the nominal current contact piece. The stationary pivot point is thus arranged so as to be movable jointly with the nominal current contact piece relative to the stationary counter contact. It is possible via the pivot element, on account of the embodiment for example of pivot arms or pivoting radii, to set a transmission behavior at the first gearing. By way of example, the pivot element itself may serve as a control element or as part of a control element, such that the pivot element is coupled indirectly or directly to the stationary counter bearing. With a linearly displaceable mounting of the first nominal current contact piece and a pivot element arranged in a stationary manner thereon, this, in cooperation with the stationary counter bearing, is to be pivoted in the event of a switching movement of the first nominal current contact piece. This is effected advantageously by a relative movability of stationary counter bearing and pivot point of the pivot element on the first nominal current contact piece. By means of the pivot element, it is possible for example to pick up a movement at different positions and at different pivoting radii of the pivot element and thus divert different movements from the pivot element. Depending on the embodiment of the pivot element, a movement direction reversal compared with the first nominal current contact piece at the first arcing contact piece can be attained for example, or a speed at the first arcing contact piece that is increased on the whole in relation to the stationary counter bearing can also be attained. This is then advantageous in particular when the movement of the first nominal current contact piece is used to introduce, via this movement, a driving force into the first gearing, to convert this there and to transmit an additional movement to the arcing contact piece.

Furthermore, the first gearing advantageously may also comprise a lever arrangement.

A lever arrangement is a mechanically simple construction for setting the transmission ratio at the first gearing. The lever arrangement can be embodied for example in the form of a single-arm or two-armed lever. By varying the effective lengths of the lever arms on the lever arrangement, a speed conversion can also be performed with the lever arrangement besides a direction conversion. By way of example, a lever arrangement can be embodied in the form of a two-armed lever or also in the form of a single-arm lever. Furthermore, the lever arrangement may also have angled levers, for example S-shaped levers, L-shaped levers or Z-shaped levers. In addition, a gearwheel for example may also be considered to be a lever arrangement, with which toothed racks or the like engage, for example.

The lever arrangement may preferably serve as a pivot element. The pivot element can be embodied for example as a single-arm lever, two-armed lever, rotating or pivotably arranged gearwheel, friction wheel, cable pulley, etc.

In accordance with a further advantageous embodiment the kinematic chain may have a second gearing in order to couple in a movement at the first nominal current contact piece.

A kinematic chain has a number of transmission elements in order to transmit a movement from a source to a drain. The kinematic chain may be constructed differently as required. By way of example, drive rods, drive chains, drive spindles, and hydraulic and pneumatic transformers, etc. may be provided in the kinematic chain. The kinematic chain thus connects, for example, a drive apparatus, at which electrical energy for example is converted into mechanical energy, wherein this drive energy is converted into a movement and is transferred to the first nominal current contact piece. Here, the kinematic chain defines the transmission path from the drive apparatus to the first nominal current contact piece. The use of a second gearing within this kinematic chain makes it possible to adapt the movement of the nominal current contact piece via the second gearing. By way of example, the second gearing may be a lever gearing with fixed lever arms or variable lever arms. The second gearing by way of example may be a gear mechanism, a friction gear, a belt drive, a chain drive, etc. Here, the second gearing advantageously may be mounted in a stationary manner.

A stationary mounting of the second gearing makes it possible to couple in a movement, with respect to the stationary counter bearing, at the nominal current contact piece, wherein a defined movement is enforced at the first nominal current contact piece and consequently also at the first arcing contact piece on account of the stationary mounting of the second gearing and the stationary mounting of the stationary counter bearing on the same base of the switching device arrangement. It is thus possible in a simple manner to always hold both the first nominal current contact piece and the first arcing contact piece in a stable position and to block any movement of the first nominal current contact piece and of the first arcing contact piece. Freewheels should thus be eliminated from the kinematic chain. The first gearing should be mounted on the nominal current contact piece in a stationary manner with respect to the first nominal current contact piece and should be movable jointly therewith. The second gearing should be mounted in a stationary manner on the base, on which the stationary counter bearing is also positioned. It is thus made possible in a simple manner to provide a movement both of the first nominal current contact piece and the first arcing contact piece, wherein the nominal current contact piece and arcing contact piece can be moved with movement profiles deviating from one another. Where applicable, movements initiated by the first or the second gearing may thus be superimposed, thereby leading to a switch-on or switch-off movement of increased speed of the first arcing contact piece compared with the first nominal current contact piece.

In accordance with a further advantageous embodiment, the kinematic chain may have an electrically insulating transmission element.

Due to the use of an electrically insulating transmission element, the creation of a continuous short circuit current path is prevented via the kinematic chain. By way of example, it is thus possible that the kinematic chain connects regions on the switching device arrangement that convey different electrical potentials. The electrically insulating transmission element separates these electrical potentials from one another and prevents the creation of a short circuit bridge. By way of example, electrically insulating rods, electrically insulating sleeves, electrically insulating belts, etc. can be used as electrically insulating transmission element.

In particular, the kinematic chain may constitute a connection between the first contact set and the second contact set and thus spans a clearance between contacts between the two contact sets. Due to the arrangement of an electrically insulating element in the region of the clearance between contacts, a short circuit of the clearance between contacts is prevented. Besides an electrically insulated spanning of the clearance between contacts, the creation of stray current in the kinematic chain can be prevented by the use of an electrically insulating transmission element. Discharges, which for example could occur within the kinematic chain, can thus be suppressed. For example, elements connected to one another rotatably may tend to build up alternating electrical potentials, such that signs of discharge may occur in the region of a joint gap. An electrically insulating transmission element may counteract the creation of signs of discharge.

In accordance with a further advantageous embodiment the electrically insulating transmission element may be an insulating nozzle protruding into the clearance between contacts.

An insulating nozzle is used in order to guide switching gases in the region of the clearance between contacts. By way of example, the arc may thus generate heated gas in the clearance between contacts on account of the thermal properties of said arc. In order to now prevent this gas from drifting away, an insulating nozzle is used. This directs the switching gas into uncritical areas, such that a switching arc can be reliably switched off and therefore reliably extinguished.

In accordance with a further advantageous embodiment the two contact sets are driven by a common drive apparatus.

A use of a common drive apparatus to drive both contact sects makes it possible at the first contact set to enforce a movement of the first nominal current contact piece and also a movement of the first arcing contact piece relative to the counter contact pieces on the second contact set. By means of a movement both of the arcing contact pieces and of the nominal current contact pieces on the first and on the second contact set, it is possible to increase the relative speed between the contact sets. A common drive unit makes it possible in a simple manner to synchronize the movements at the first and at the second contact set to one another and thus drive the contact pieces in and out in an exact manner. Furthermore, by the use of a kinematic chain, a movement can be effected both on one contact side and on the other contact side of the clearance between contacts. The use of gearings, for example of a first and of a second gearing, makes it possible to apply different movement profiles to different contact pieces in spite of the use of the same drive apparatus.

In particular with the use of a common drive apparatus, the use of an electrically insulating transmission element within the kinematic chain is advantageous, since a short circuit bridge between the first contact set and the second contact set is thus avoided.

In accordance with a further advantageous embodiment, the first gearing and the second gearing can be arranged in succession in the direction of the flow of force.

With an arrangement of the first and second gearing in succession in the direction of the flow of force, it is possible for example to couple a movement, for example from the kinematic chain, into the second gearing, to convert this movement in the second gearing and where appropriate to apply this movement to a first nominal current contact piece and to use the movement delivered from the second gearing as an input variable of the first gearing, to convert this in the first gearing and to impress this in turn as an output variable onto the first arcing contact piece. By means of a combination of this type, it is made possible to synchronize the movements at the first contact set relative to one another and to repeat the course of movement practically arbitrarily at low cost. With an arrangement of this type it is also made sure, by means of the mechanical coupling, that in the event of a failure of the drive apparatus a complete standstill is implemented both at the first and at the second gearing. An isolated action of the first or second gearing is thus counteracted. Undefined switching states at the switching device arrangement, which might lead to disruptions, are thus prevented. In particular, a movability of the gearings relative to one another (in particular of pivot points of the gearings) makes it possible to decouple a movement at each of the gearings, wherein one of the movements may originate from a combination of individual movements of the gearings.

It may be advantageous if the second gearing has a rotation element mounted in a stationary manner.

By way of example, a rotation element mounted in a stationary manner is positioned in a stationary manner on the base, on which the stationary counter bearing is also arranged. It is thus possible in a simple manner to convert a rotary movement and to perform this synchronously with the movement of the first gearing. Different devices can be used as rotation elements.

A rotary bearing of a shaft of the rotation element should be arranged at a fixed angle to the stationary bearing point.

In accordance with a further advantageous embodiment the rotation element is a gearwheel.

A gearwheel makes it possible, for example by the use of a number of gearwheels coupled on a shaft, to generate a transmission in the second gearing in a simple manner, such that movements in and out at the second gearing deviate from one another. A gearwheel may also be formed merely in portions, for example in the form of a sector of a circle, such that a pivot movement can be performed about the pivot angle of the sector of a circle. By way of example, by means of toothed racks, movement can be coupled in at and decoupled from the pivot element.

The rotation element may also advantageously be a pivot lever.

A pivot lever for example may be a single-arm or two-armed lever, to which connecting rods are attached. However, the pivot lever may also be formed at least with one pivot arm in the form of a slotted guide path, wherein the effective length of a lever arm varies depending on the execution of a movement of the pivot element. By way of example, it is thus possible to change the transmission of a pivot movement of the pivot element depending on the execution of said movement. By way of example, a greater transmission may be provided at the first gearing at the start of a movement coupled in at the pivot element than at the end of a pivot movement of the pivot element.

In addition, further constructions and combinations of different machine components for forming a rotation element that is mounted in a stationary manner can also be selected.

In accordance with a further advantageous embodiment one of the gearings, in particular the second gearing, may convert a driving movement into an oppositely directed driven movement, and the other gearing, in particular the first gearing, may amplify the oppositely directed movement.

In particular by the use of the second gearing to reverse one direction of movement of a coupled-in movement, it is made possible, for example with use of a common drive for driving the first and the second contact set, to generate a movement in the opposite direction between the two contact sets. It is thus possible in the event of a switch-on operation for the nominal current contact pieces to move toward one another in a synchronized manner, and in the event of a switch-off operation for the nominal current contact pieces to move away from one another in a synchronized manner. If the first gearing is also used in order to amplify the oppositely directed movement, the fundamental movement of the nominal current contact pieces can thus enforce, by a driving at least of the first arcing contact piece via the first gearing, a leading or lagging of the first arcing contact piece in relation to the first nominal current contact piece. It is thus possible for the arcing contact pieces of the first and second contact set to be movable relative to one another with a quicker contacting speed or contact separation speed compared with the nominal current contact pieces of the first and second contact set.

An exemplary embodiment of the invention will be shown hereinafter in a drawing and will be described hereinbelow in greater detail.

DESCRIPTION OF THE INVENTION

FIGS. 1 to 16 illustrate different variants of switching device arrangements. Here, the switching device arrangements are constructed identically in principle. However, the respective functional modules (for example gearings) may be embodied differently. The differently embodied functional modules can each be replaced for one another in the individual variants of the switching device arrangements. The primary structure and the primary mode of operation of a switching device arrangement in a first variant will be described firstly with reference to FIGS. 1 to 5. The second variant shown in FIGS. 6 to 10, the third variant shown in FIGS. 11 and 12, and the fourth variant shown in FIGS. 13 and 14 and the fifth variant shown in FIGS. 15 and 16 differ from one another with regard to the design of individual functional modules, wherein the function and structure are maintained in principle. Individual functional modules (for example gearings) of the different variants can be exchanged for one another.

Figure 1:
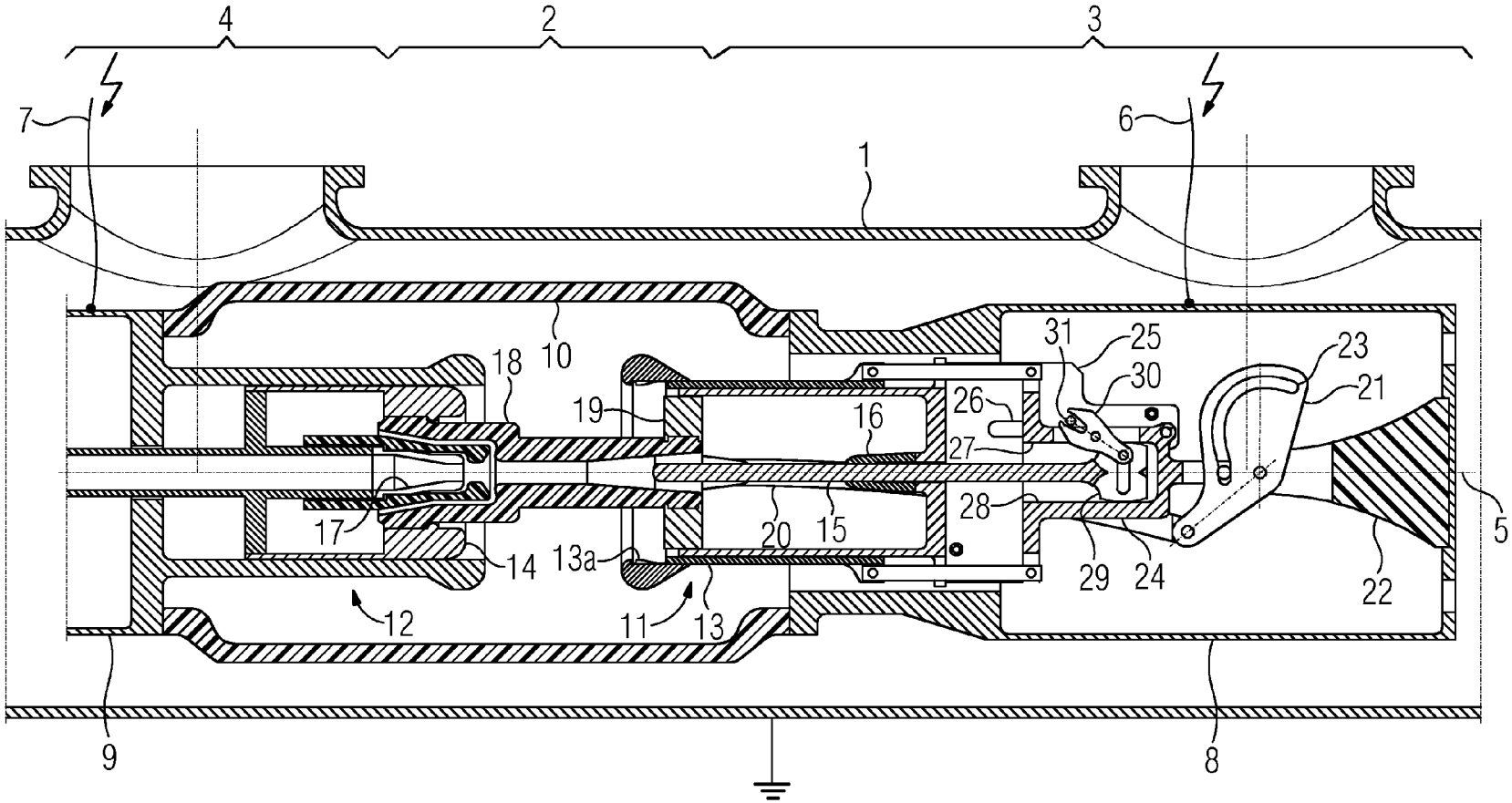
FIGS. 1 to 5 show a first variant of a switching device arrangement.

The first variant of a switching device arrangement shown in FIG. 1 has an encapsulating housing 1. The encapsulating housing 1 is formed in the present case from electrically conductive materials, wherein the encapsulating housing itself is grounded. However, the encapsulating housing may also be formed at least in portions or completely from an electrically insulating material. The encapsulating housing 1 forms a barrier around an internal volume in order to enclose an electrically insulating fluid within the encapsulating housing 1. This electrically insulating fluid should preferably be present in the gaseous state. It is thus advantageous by way of example to enclose a gas such as sulfur hexafluoride, nitrogen or $CO_2$ in the interior of the encapsulating housing 1. Alternatively, however, the interior of the encapsulating housing 1 may also be filled with an insulating liquid, such as an insulating oil or an insulating ester. In order to increase the electrical insulation of the fluid in the interior of the encapsulating housing 1, it is advantageous to subject the fluid to an overpressure, such that the encapsulating housing 1 is to be formed as a pressure vessel, which withstands a differential pressure between the interior and the exterior of the encapsulating housing 1. Atmospheric air is preferably located outside the encapsulating housing 1 and is below atmospheric pressure.

An interrupter unit of the switching device arrangement is arranged within the encapsulating housing 1. The interrupter unit is supported in an electrically insulated manner with respect to the encapsulating housing 1. In order to support the interrupter unit, solid insulators can be used by way of example, which provide a supporting effect in relation to the encapsulating housing 1. For reasons of clarity, in FIG. 1 an illustration of the support of the interrupter unit there in the interior of the encapsulating housing 1 has been omitted.

Merely an individual interrupter unit or a number of interrupter units electrically insulated with respect to one another may be arranged in the interior of the encapsulating housing 1. It is thus possible, by way of example, to arrange a plurality of interrupter units within a common encapsulating housing, which serve to switch a plurality of phases of a polyphase electrical energy transmission system. With an arrangement of an individual interrupter unit within an individual encapsulating housing 1 (as illustrated in FIG. 1), a plurality of encapsulating housings 1 are to be provided accordingly with a plurality of interrupter units in order to form a switching device arrangement that can also switch polyphase electrical energy transmission systems.

The interrupter unit, as shown in FIG. 1 *ff.*, is an interrupter unit of a high-voltage circuit breaker, which serves to interrupt an electrical current. The interrupter unit according to FIG. 1 *ff.* serves to interrupt or to establish a current path. The interrupter unit has a clearance between contacts 2. The clearance between contacts 2 divides the interrupter unit into a first contact side 3 and a second contact side 4. The two contact sides 3, 4 are arranged here substantially coaxially with a longitudinal axis 5. The two contact sides 3, 4 each comprise parts of the current path to be interrupted, wherein the electrically conductive parts of the respective contact sides 3, 4 preferably permanently convey the same electrical potential. The two contact sides 3, 4 are electrically insulated from one another at the separation point of the clearance between contacts 2, such that a potential difference can be kept electrically insulated via the clearance between contacts 2. In order to incorporate the interrupter unit of the switching device arrangement, the first contact side 3 is connected to a first connection line 6. Similarly, the second contact side 4 is also connected to a second connection line 7. The two connection lines 6, 7 are each guided through a wall of the encapsulating housing 1 in a manner electrically insulated via connection pieces arranged on the circumferential side in the encapsulating housing 1. Bushing modules not shown in the figures are arranged on the connection pieces. It is thus possible to introduce a connection line 6, 7 through an electrically conductive encapsulating housing 1 into the interior of the encapsulating housing 1. It is thus possible to incorporate the current path, which can be switched via the interrupter unit, into an electrical energy transmission network outside the encapsulating housing 1. For this purpose, outdoor bushings can be arranged for example on the connection pieces of the encapsulating housing 1 as bushing modules and can be connected to corresponding overhead lines via overhead conductors.

The first contact side 3 has a first armature body 8. The first armature body 8 is formed in the present case from a number of parts, wherein the first armature body 8 is a substantially hollow rotation body, which is oriented coaxially with the longitudinal axis 5. In its interior, the first armature body 8 has a receiving space, in which a gearing can be arranged, for example. The interior of the first armature body 8 is dielectrically shielded, since the first armature body 8 is formed from an electrically conductive material. Alternatively to a multi-part embodiment, the first armature body 8 may also be formed in one part. The first connection line 6 is connected to the first armature body 8, such that an electrical potential can be transmitted to the first armature body 8 and the first armature body 8 is part of a switchable current path. The first armature body 8 is mounted in a stationary manner and forms a stationary base.

The second contact side 4 has a second armature body 9. The second armature body 9 deviates in terms of its shaping from the first armature body 8. However, the second armature body 9 is also formed in a number of parts, similarly to the first armature body 8, wherein the second armature body 9 is also formed preferably as a substantially rotationally symmetrical hollow body, which has in its interior a receiving space. The second armature body 9 should be oriented with its axis of rotation coaxial with the longitudinal axis 5. Here, end faces of the first armature body 8 and the second armature body 9 should face toward one another. It may be that the end faces facing toward one another of the two armature bodies 8, 9 are interconnected via an electrically insulating component 10. The electrically insulating component 10 may produce, for example in the form of one or more insulating bars, a mechanical stiffening between the two armature bodies 8, 9 of the first contact side 3 and of the second contact side 4. In addition, the electrically insulating component 10 may also be arranged coaxially with the longitudinal axis 5 for example in the manner of a pipe, wherein the end faces of a pipe of this type facing away from one another are connected to the first and to the second armature body 8, 9 respectively. However, deviating shapings of the electrically insulating component 10 may also be provided. By way of example, ceramic materials, glass fiber-reinforced plastics, insulating resins, etc. are suitable as electrically insulating materials for forming the electrically insulating component 10. A closed switching device can be formed on the interrupter unit of a switching device arrangement by an electrically insulating component 10.

The two armature bodies 8, 9 of the first and the second contact side 3, 4 each delimit the outer enveloping contour of the interrupter unit. The two armature bodies 8, 9 are arranged at a fixed angle to one another and form a stationary base. The two armature bodies 8, 9 are preferably formed from an electrically conductive material, for example aluminum or copper, which on the one hand form a current path portion of the switchable current path and on the other hand provide mechanical stabilization of the interrupter unit. A first contact set 11 and a second contact set 12 are mounted movably on the first armature body 8 and on the second armature body 9. The two contact sets 11, 12 are each connected electrically conductively to the respective armature body 8, 9. The first contact set 11 has a first nominal current contact piece 13. The first nominal current contact piece 13 is substantially tubular and is arranged coaxially with the longitudinal axis 5. Furthermore, the first nominal current contact piece 13 is mounted on the first armature body 8 so as to be displaceable along the axis 5. The first armature body 8 thus forms a stationary base for the first nominal current contact piece 13. At its end facing toward the second armature body 9, the first nominal current contact piece 13 is equipped with flexibly deformable contact fingers 13*a*. The flexibly deformable contact fingers 13*a* are designed to pass over a contact piece formed in a mirror-inverted manner. A contact piece of this type formed in a mirror-inverted manner is formed on the second contact arrangement 12 in the form of a substantially tubular second nominal current contact piece 14. In the present case both the first nominal current contact piece 13 and the second nominal current contact piece 14 are mounted movably, such that, during a switching movement of the interrupter unit of the switching device arrangement, the two nominal current contact pieces 13, 14 are moved. The second nominal current contact piece 14 is formed here substantially rotationally symmetrically and is arranged coaxially with the longitudinal axis 5. The circumferential-side cross section of the second nominal current contact piece 14 is formed here in a mirror-inverted manner in relation to the flexible contact fingers 13*a* of the first nominal current contact piece 13, such that the contact fingers 13*a* can slide over the outer circumferential side of the substantially tubular nominal current contact piece 14. The second nominal current contact piece 14 is guided displaceably in a tubular neck of the second armature body 9 along the longitudinal axis 5. The tubular neck of the second armature body 9 is thickened in a bead-like manner at its end facing toward the first armature body 8, such that a dielectrically shielding shaping is attained in the region of the clearance between contacts 2. Similarly, on the outer circumference of the first nominal current contact piece 13 in the region of the flexible contact fingers 13*a*, a toroidal widening is provided on the first nominal current contact piece 13 and serves to dielectrically shield the clearance between opening contacts 2.

The first nominal current contact piece 13 is assigned a first arcing contact piece 15. Here, the first arcing contact piece 15 is pin-shaped and is mounted slidingly on the first nominal current contact piece 13. The first nominal current contact piece 13 surrounds the first arcing contact piece 15, wherein the first arcing contact piece 15 and the first nominal current contact piece 13 are oriented coaxially with one another and with the longitudinal axis 5. In order to guide the first arcing contact piece 15 in a sliding manner, the first nominal current contact piece 13 is equipped with a guide bush 16. The second nominal current contact piece 14 is equipped with a second arcing contact piece 17. The second arcing contact piece 17 is formed in a substantially bush-like manner and is arranged in a mirror-inverted manner with respect to the pin-shaped first arcing contact piece 15. It is thus possible for the pin-shaped first arcing contact piece 15 to enter the bush opening of the second arcing contact piece 17. The second arcing contact piece 17 is arranged coaxially with the longitudinal axis 5 and coaxially with the second nominal current contact piece 14. Here, the second arcing contact piece 17 conveys the same electrical potential as the second nominal current contact piece 14. In the present case the second nominal current contact piece is connected at a fixed angle to the second arcing contact piece 17. The first nominal current contact piece 13 and the first arcing contact piece 15 are arranged movably relative to one another and permanently convey the same electrical potential. An insulating nozzle 18 is attached to the second nominal current contact piece 14. The insulating nozzle 18 is secured to the second nominal current contact piece 14 on the inner circumferential side and surrounds the contact region of the second arcing contact piece 17. Here, the insulating nozzle 18 is formed as a rotationally symmetrical body and has an insulating nozzle channel, within which part of the clearance between contacts 2 extends. The contact region of the first arcing contact piece 15 also protrudes into the insulating nozzle channel, wherein the end of the insulating nozzle 18, which protrudes in the direction of the second armature body 9, is in turn surrounded at least in portions by the first nominal current contact piece 13. An annular coupling element 19 is also arranged on the insulating nozzle 18. A drive apparatus is attached to the second arcing contact piece 17 or to the second nominal current contact piece 14 and can displace the second nominal current contact piece 14 and the second arcing contact piece 17 in the direction of the longitudinal axis 5. In order to transfer the interrupter unit from the switch-off position shown in FIG. 1 into a switch-on position (see FIG. 5), an axial movement of the second arcing contact piece 17 or of the second nominal current contact piece 14 is performed in the direction of the second armature body 9. The first and the second armature body 8, 9 here remain still and each form the base for the movable parts, which are arranged on/in the first and second armature body 8, 9.

A movement of the second nominal current contact piece 14 is also transmitted to the insulating nozzle 18. The insulating nozzle 18 is in turn coupled to a connecting rod 20, which transmits an axial movement of the insulating nozzle 18. Via its end facing away from the insulating nozzle 18, the connecting rod 20 is connected to a pivot element 21 of a second gearing. The pivot element 21 or rather the second gearing is mounted here in a stationary manner on the first armature body 8. In the present variant a pivot point (shaft bearing) of the pivot element 21 is for this purpose to be mounted on the first armature body 8 in a manner electrically insulated via an insulating body 22. The insulating body 22 is substantially conical, wherein it is arranged coaxially with the longitudinal axis 5. A pivot point of the pivot element 21 of the second gearing is arranged perpendicularly on the longitudinal axis 5. The connecting rod 20 is connected to a lever arm of the pivot element 21, such that a movement of the nominal current contact piece 14 in the direction of the longitudinal axis 5 can be converted via the insulating nozzle 18 and the connecting rod 20 attached to the insulating nozzle 18 into a pivot movement of the pivot element 21. The pivot element 21 has a slotted guide path 23, with which a pin engages. The pin, which engages with the slotted guide path 23, is oriented transversely to the longitudinal axis 5 and is displaceable in the direction of the longitudinal axis 5. The pin engaging with the slotted guide path 23 is connected here to a sleeve 24 of the first nominal current contact piece 13 at a fixed angle. The sleeve 24 forms a fixed-angle unit together with the first nominal current contact piece 13. It is thus possible to convert an axial movement of the second nominal current contact piece 14 via the connecting rod 20, the pivot element 21 and the slotted guide path 23 into a pivot movement and to convert this pivot movement in turn into a linear movement of the sleeve 24 or of the first nominal current contact piece 13. The second gearing with the pivot element 21 thus converts the linear movement starting from the second nominal current contact piece 14 into a linear movement with a reversed direction. Due to the shaping of the slotted guide path 23, this is associated with a gearing down of the movement, such that the oppositely directed movement, which is transmitted to the first nominal current contact piece 13, has a varying movement profile compared with the movement profile of the second nominal current contact piece 14.

In order to assist the linear guidance of the sleeve 24 and of the first nominal current contact piece 13, the first armature body 8 is equipped with an auxiliary console 25. The auxiliary console 25 of the first armature body 8 forms a stationary counter bearing, similarly to the first armature body 8 itself. A linear slotted guide path 26 is arranged in the auxiliary console 25, which path is engaged by guide elements of the sleeve 24, such that the sleeve 24 is linearly displaceable. The guide elements may preferably be formed as pins, which protrude into the same slotted guide path 26 and are distanced from one another. Accordingly, the two pins constitute stops, such that the axial displaceability of the sleeve 24 (and therefore of the first nominal current contact piece 13) is limited.

Two parallel sliding surfaces 27, 28 are arranged in the sleeve 24 and are oriented in opposite directions to one another and in line with the longitudinal axis 5. A hammerhead 29 of the first arcing contact piece 15 is arranged in the sleeve 24. The hammerhead 29 travels over the two sliding surfaces 27, 28 and guides the first arcing contact piece 15 jointly with the guide bush 16 and ensures a linear movement of the first arcing contact piece 15 along the longitudinal axis 5. In order to enforce a movement of the first arcing contact piece 15 relative to the first nominal current contact piece 13, a second gearing is provided. The second gearing is mounted on the first nominal current contact piece 13, in particular on the sleeve 24 of the second nominal current contact piece 14. There, a pivot point is attached, in which a pivot element in the form of a fork lever 30 can be moved. The fork lever 30 protrudes freely via its fork end into the space, wherein the fork end of the fork lever 30 is designed to engage with a stationary counter bearing 31. The fork end acts as a slotted guide path. The stationary counter bearing 31 is embodied in the form of a pin, which is attached to the auxiliary console 25 in a manner oriented perpendicularly to the longitudinal axis 5. The fork lever 30 is guided displaceably via its second end in a slot of the hammerhead 29. The slot of the hammerhead 29 is oriented here substantially transversely to the longitudinal axis 5, such that it is possible to compensate for an overstroke of the fork lever 30.

A transfer of the switching device arrangement shown in FIG. 1 from its switch-off position (FIG. 1) into its switch-on position (FIG. 5) will be described hereinafter with reference to the sequence of FIGS. 1, 2, 3, 4 and 5. A movement of the second nominal current contact piece 14 or rather of the second arcing contact piece 17 is first performed by means of a drive apparatus (not illustrated in FIG. 1) in the direction of the first nominal current contact piece 13 and of the first arcing contact piece 15. During this movement the insulating nozzle 18 is also moved and transmits its linear movement via the connecting rod 20 to the pivot element 21 of the second gearing. A movement is transmitted to the first nominal current contact piece 13 via the pivot movement of the pivot element 21 of the second gearing. The insulating nozzle 18 thus bridges the clearance between contacts between the two contact sides 3, 4 in an electrically insulated manner and acts as an electrically insulating element in a kinematic chain, which serves to initiate a movement of the first nominal current contact piece 13. With a movement of the second nominal current contact piece 14 towards the first nominal current contact piece 13, the contacting speed is increased by the oppositely directed movement of the first nominal current contact piece 13. Since the annular coupling element 19 is connected to the insulating nozzle 18, the annular coupling element 19 is also moved with the insulating nozzle 18. Due to the rotatable mounting of the pivot element 30 on the first nominal current contact piece 13, the first gearing is also moved with the movement of the first nominal current contact piece 13. Here, the stationary counter bearing 31 located on the auxiliary console 25 slides in the form of a pin through the fork end of the fork lever 30. The fork lever 30 is moved past the stationary counter bearing 31 and in so doing is rerouted by the operative connection between stationary counter bearing 31 and the first gearing. Accordingly, on account of the connection of the fork lever 30 to the hammerhead 29 of the first arcing contact piece 13, the movement of the stationary counter bearing 31 relative to the first nominal current contact piece 13 is converted into a movement of the first arcing contact piece 15. On account of the displaceable mounting of the first gearing, the movement of the first arcing contact piece 15 superimposes the movement of the first nominal current contact piece 13, such that the speed of the movement of the first arcing contact piece 15 with respect to the base of the stationary counter bearing 31 or rather of the first armature body 8 or of the second armature body 9 is greater than the speed of the movement of the first nominal current contact piece 13.

Figure 2:
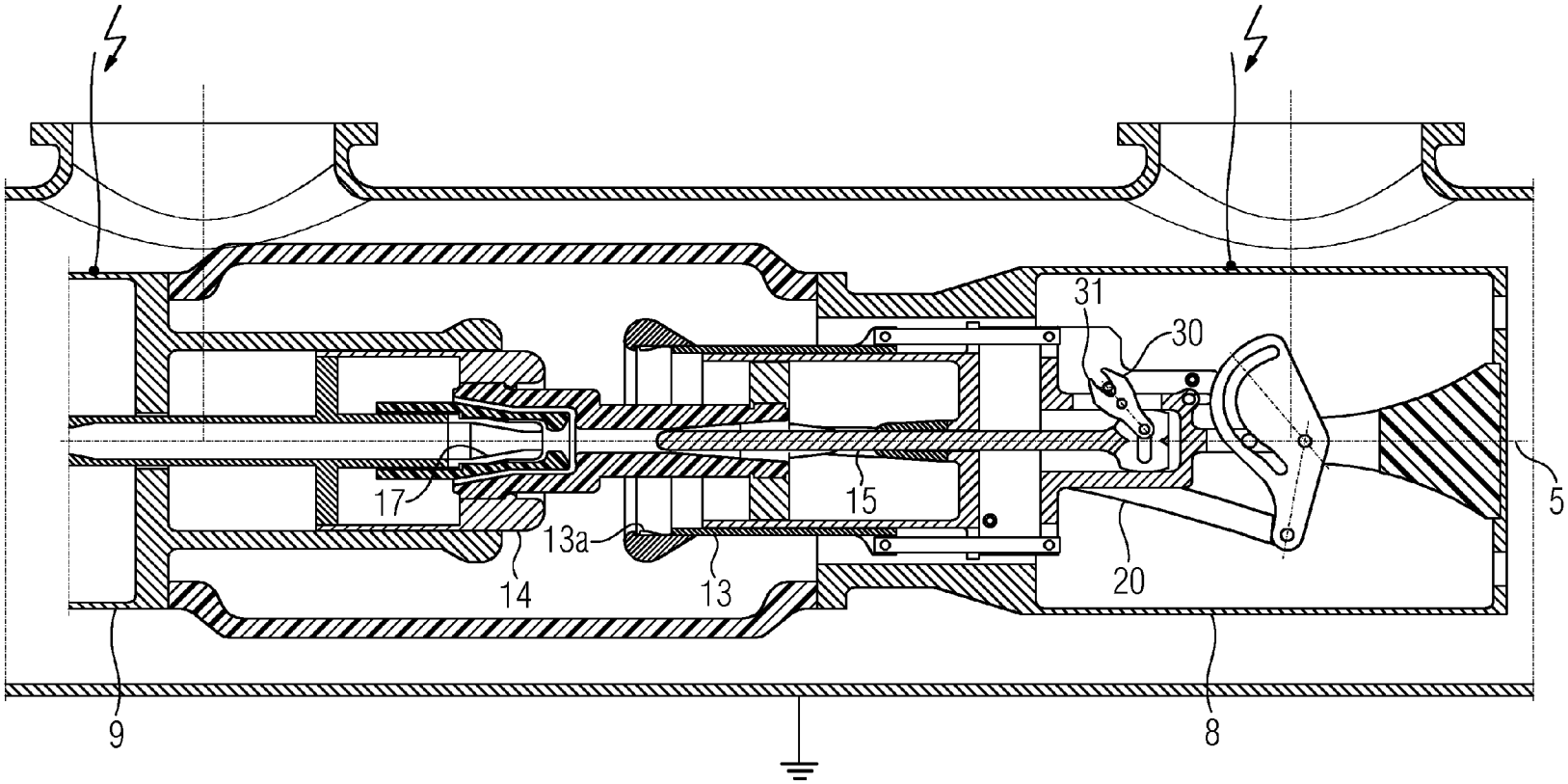
Figure 3:
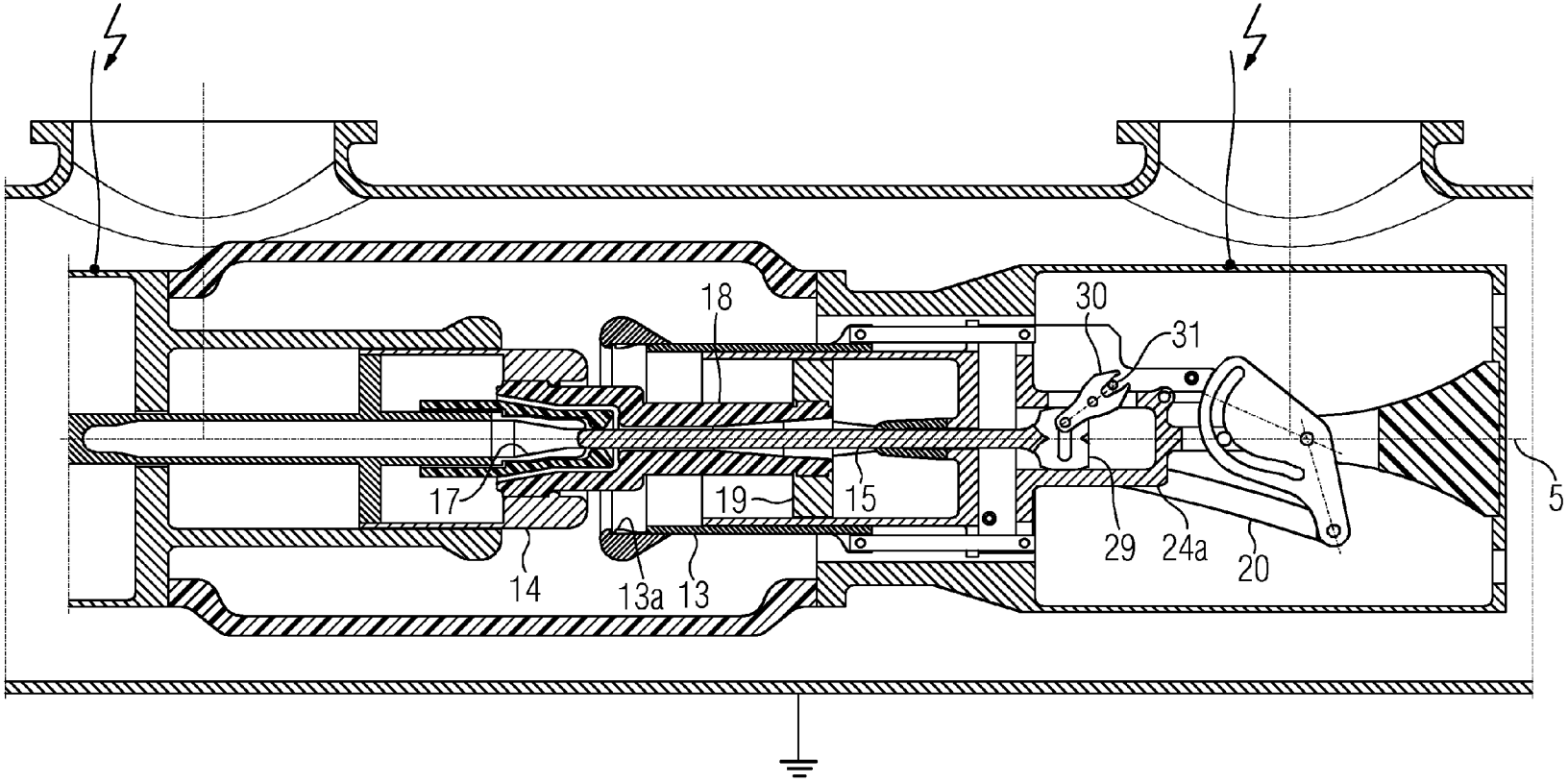
Figure 4:
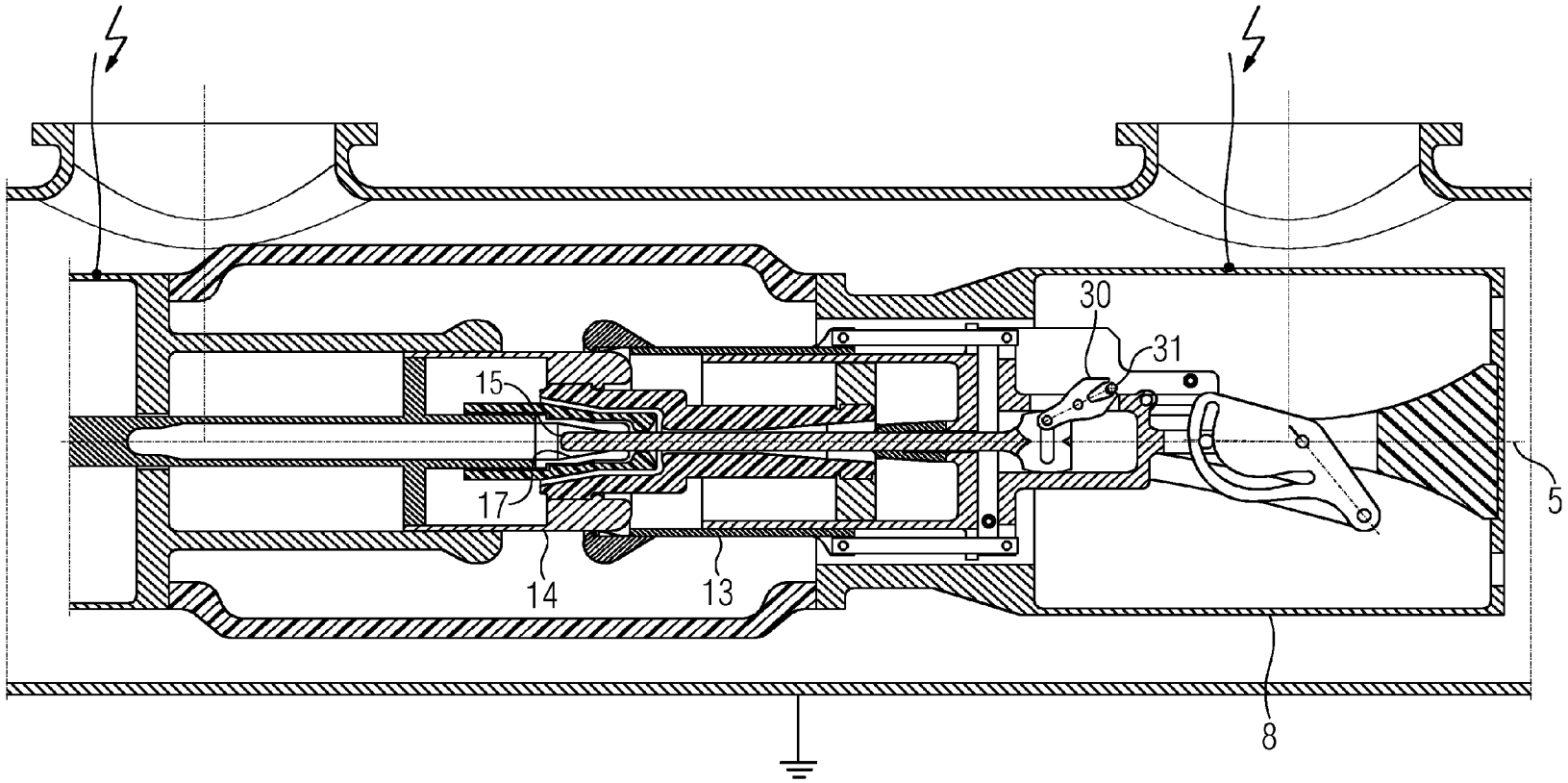
Figure 5:
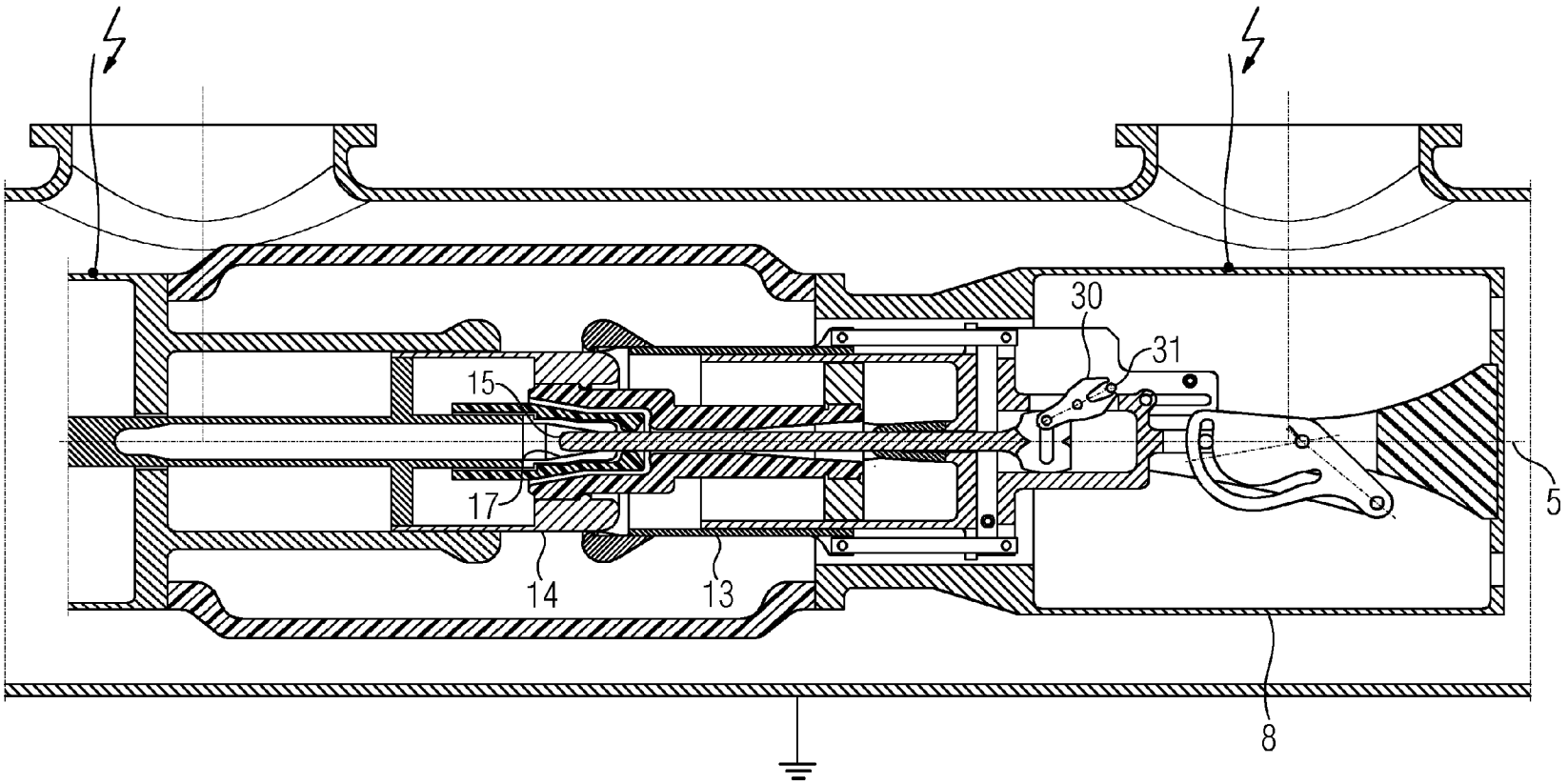
Figure 6:
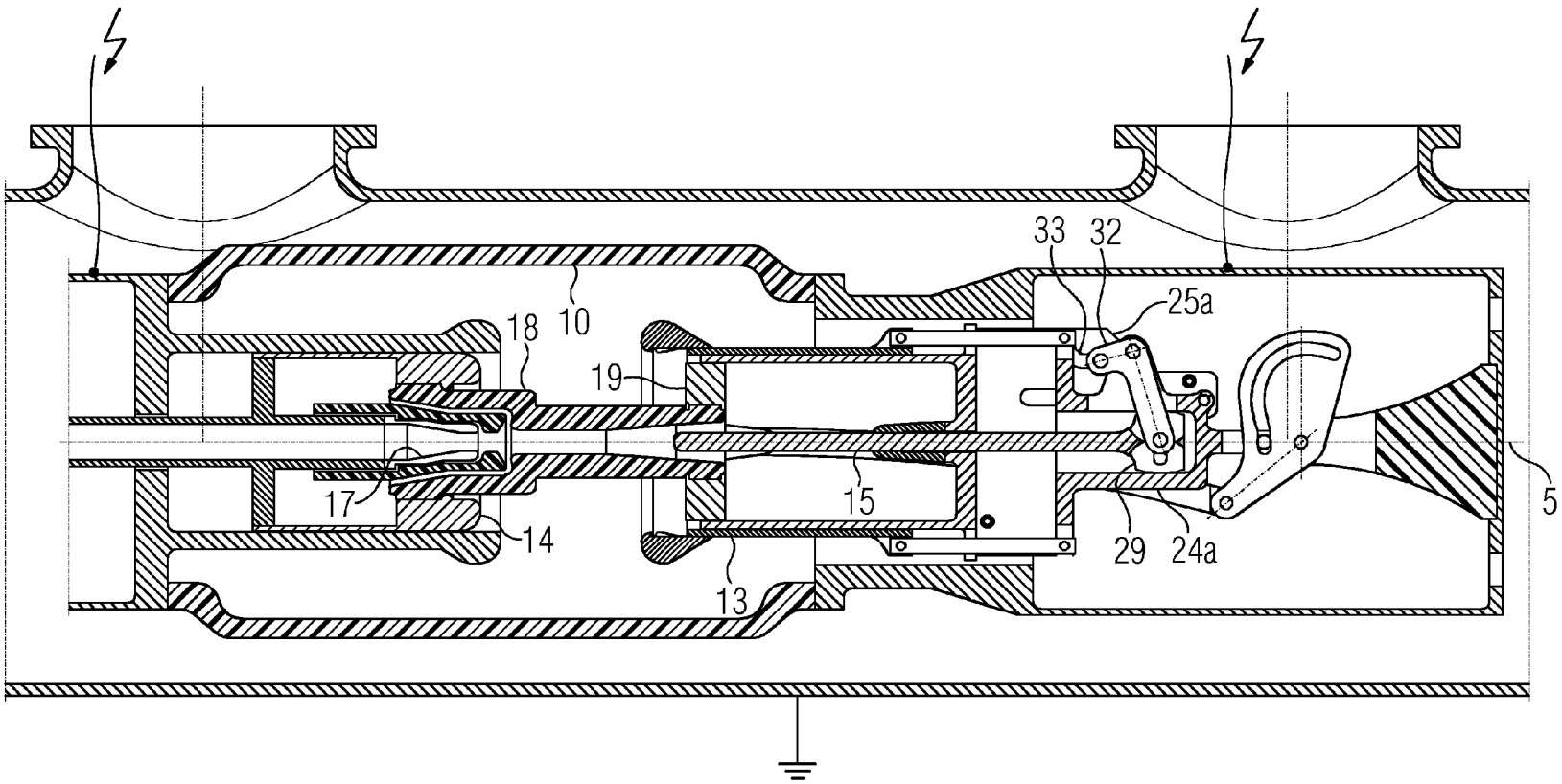
FIGS. 6 to 10 show a second variant of a switching device arrangement.
Figure 7:
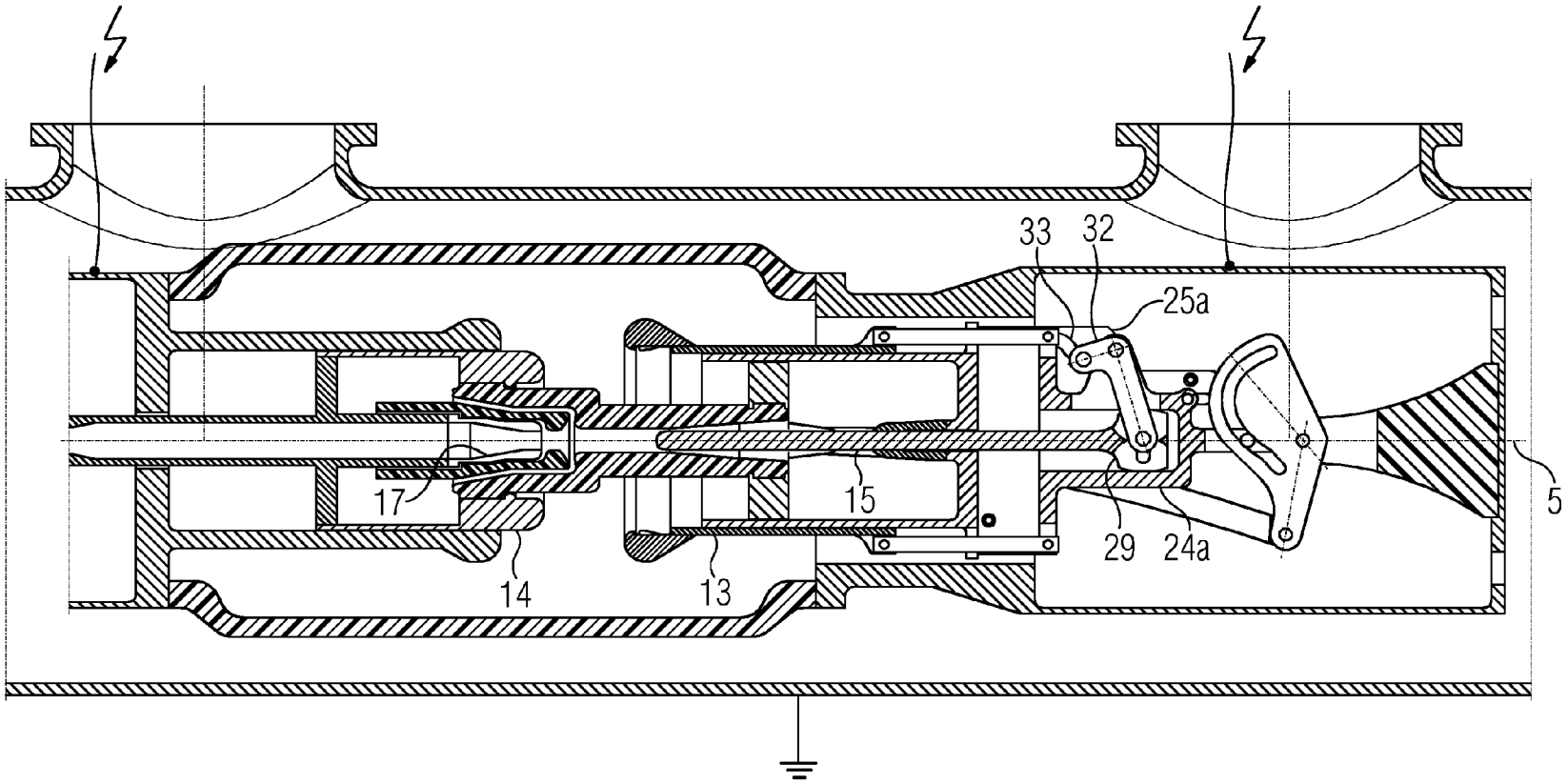
Figure 8:
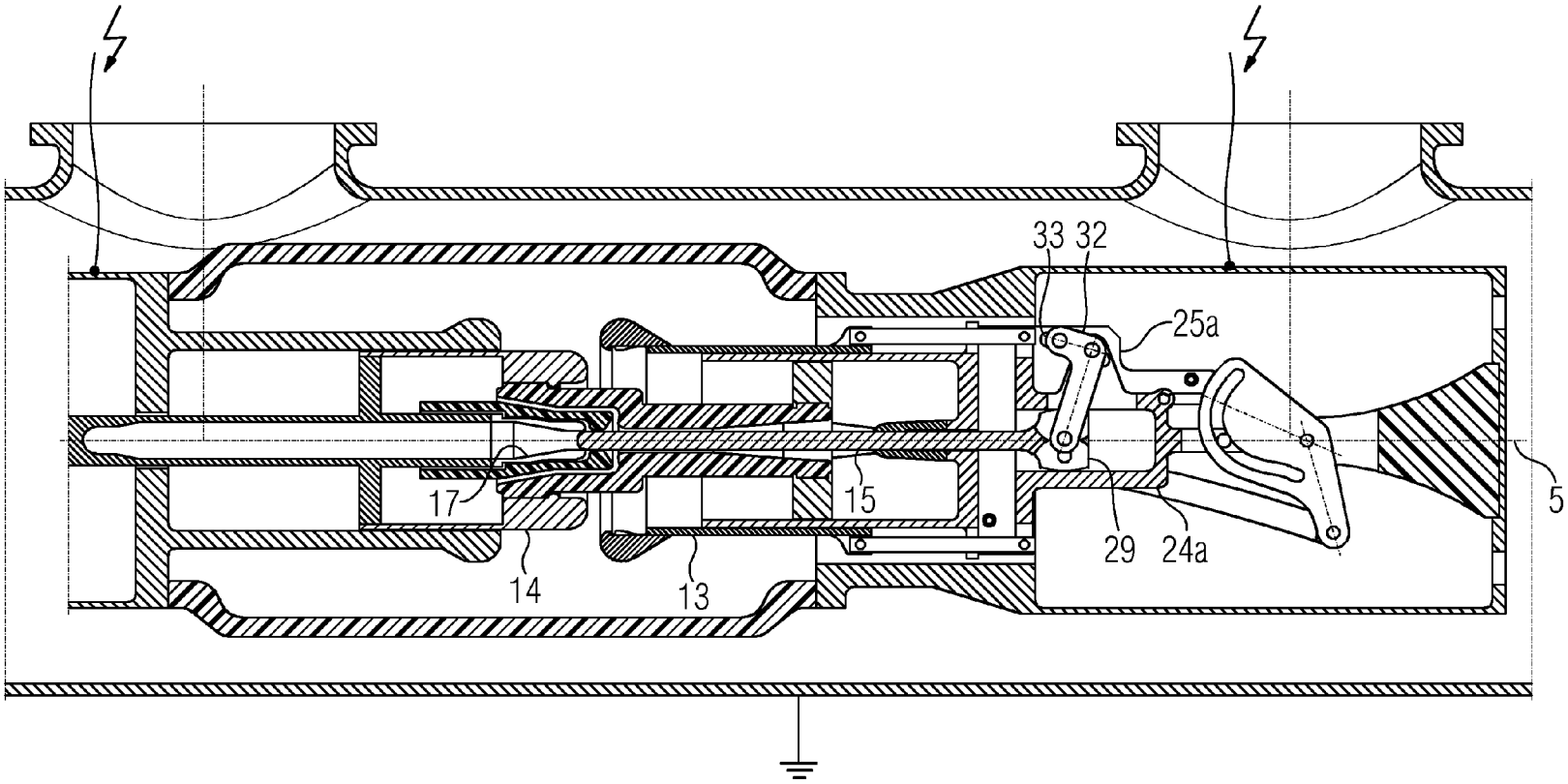
Figure 9:
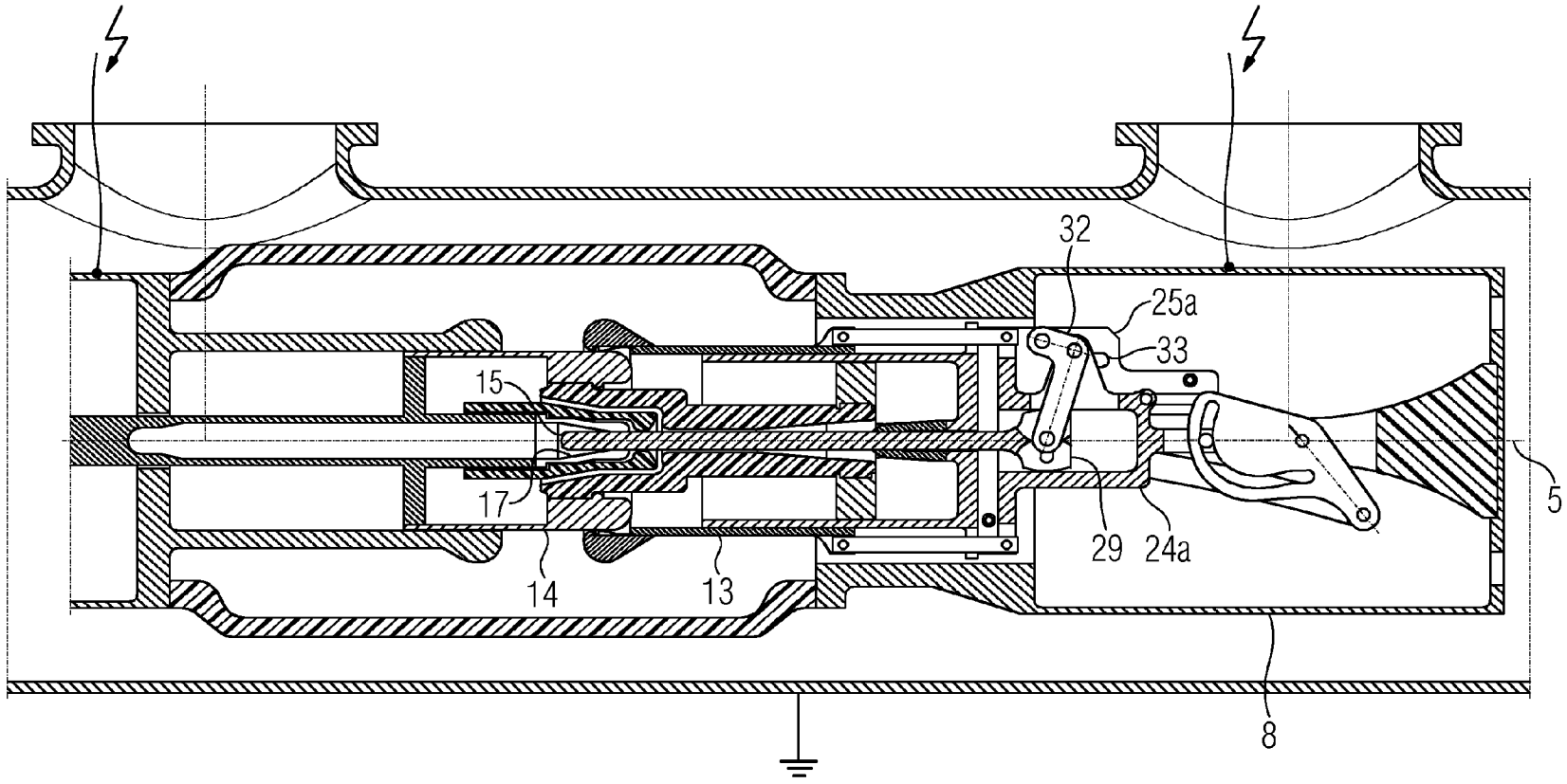
Figure 10:
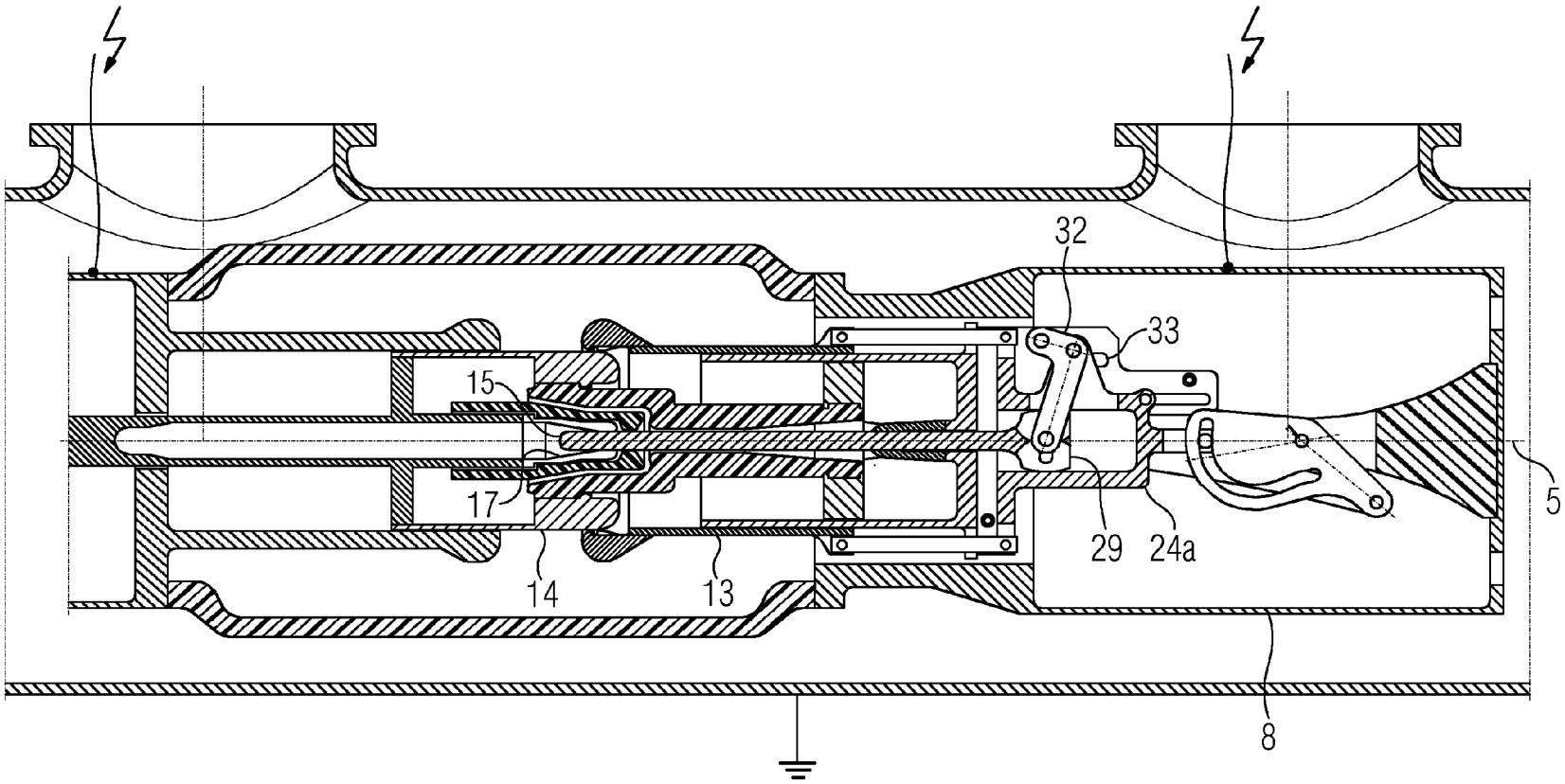

A progression of the movement of the second nominal current contact piece 14 and of the second arcing contact piece 17 is shown in FIG. 2. The insulating nozzle 18, via the connecting rod 20, has pushed the pivot element 21 around to such an extent that the first nominal current contact piece 13 has already moved out from its rest position. The stationary counter bearing 31 is engaged with the pivot element 30 of the first gearing. A movement of the first arcing contact piece 15 progresses, superimposing the movement of the first nominal current contact piece 13. FIG. 3 shows a further progression of the relative movement of the nominal current contact pieces 13, 14 and of the arcing contact pieces 15, 17. The fork lever 30 serving as pivot element is turned. The two arcing contact pieces 15, 16 have already contacted one another. Proceeding from the initial bringing of the two nominal current contact pieces 13, 14 toward one another, a leading contacting of the arcing contact pieces 15, 17 is ensured by a superimposition of the additional movement of the first arcing contact piece 15. Once the arcing contact pieces 15, 17 have been contacted, the relative movement, i.e. the bringing of the nominal current contact pieces 13, 14 toward one another, is continued. A further transmission of an additional movement to the first arcing contact piece 15 via the first gearing is no longer necessary, since the arcing contact pieces 15, 17 have already been contacted. The first gearing can be fixed in this position, such that the first arcing contact piece 15 cannot move unintentionally. The fork of the fork lever 30 acts as a slotted guide path. As the movement continues further, the counter movement of the first nominal current contact piece 13 is advanced further via the second gearing. FIG. 4 illustrates the moment at which the nominal current contact pieces 13, 14 contact one another. A further continuance of the movement of the nominal current contact pieces 13, 14 leads to a movement of the second gearing into an extended position. The pin of the counter bearing 31 still lies in the fork of the fork lever 30, such that the position of the first nominal current contact piece 13 is secured via the first gearing.

FIGS. 6, 7, 8, 9 and 10 illustrate a second variant of a switching device arrangement. Apart from the embodiment of the first gearing, the mode of operation and the course of movement correspond to those described previously with reference to FIGS. 1 to 5. Only the deviating embodiment of the first gearing will therefore be discussed hereinafter.

Figure 11:
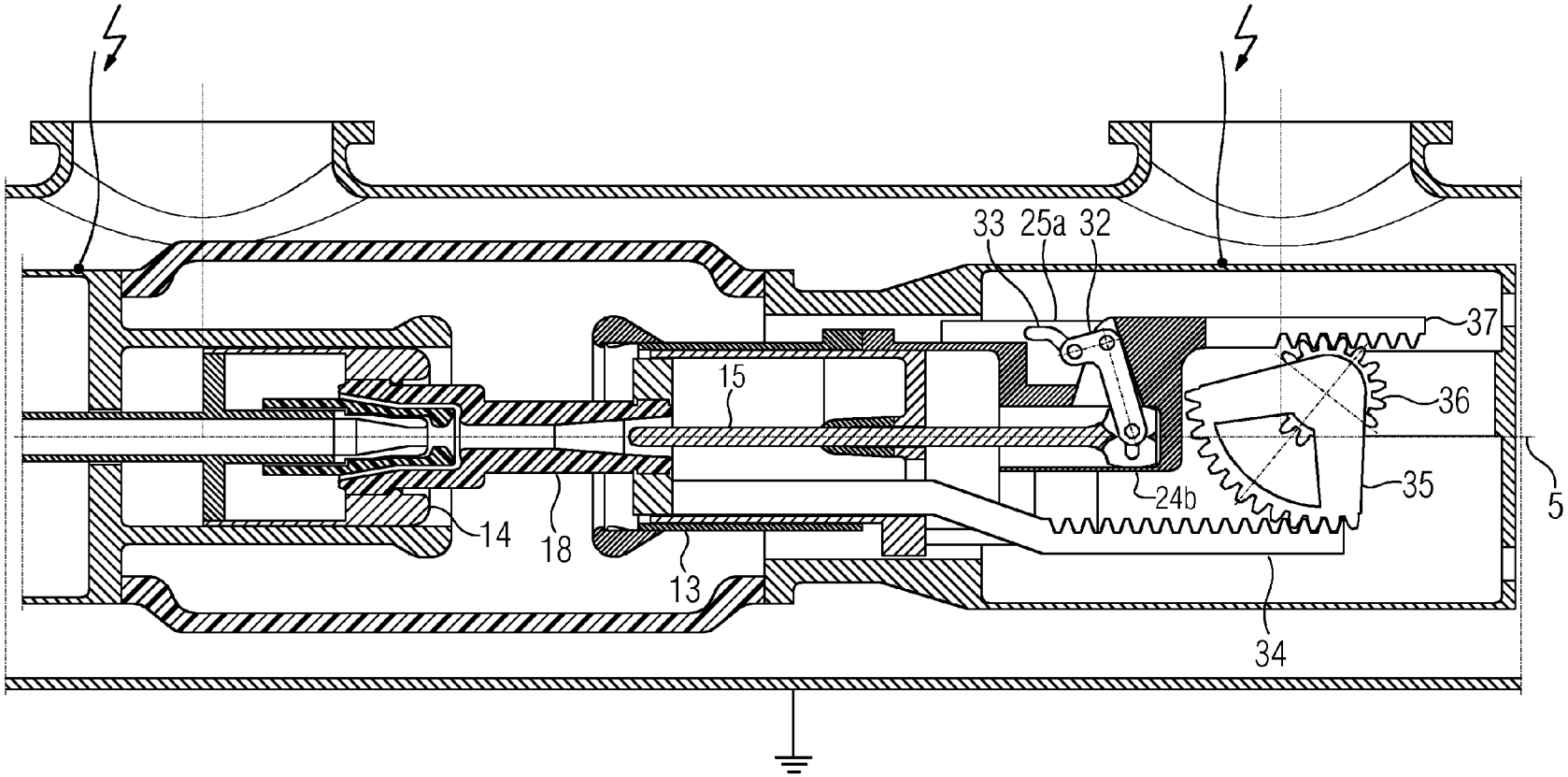
FIGS. 11 to 12 show a third variant of a switching device arrangement.
Figure 12:
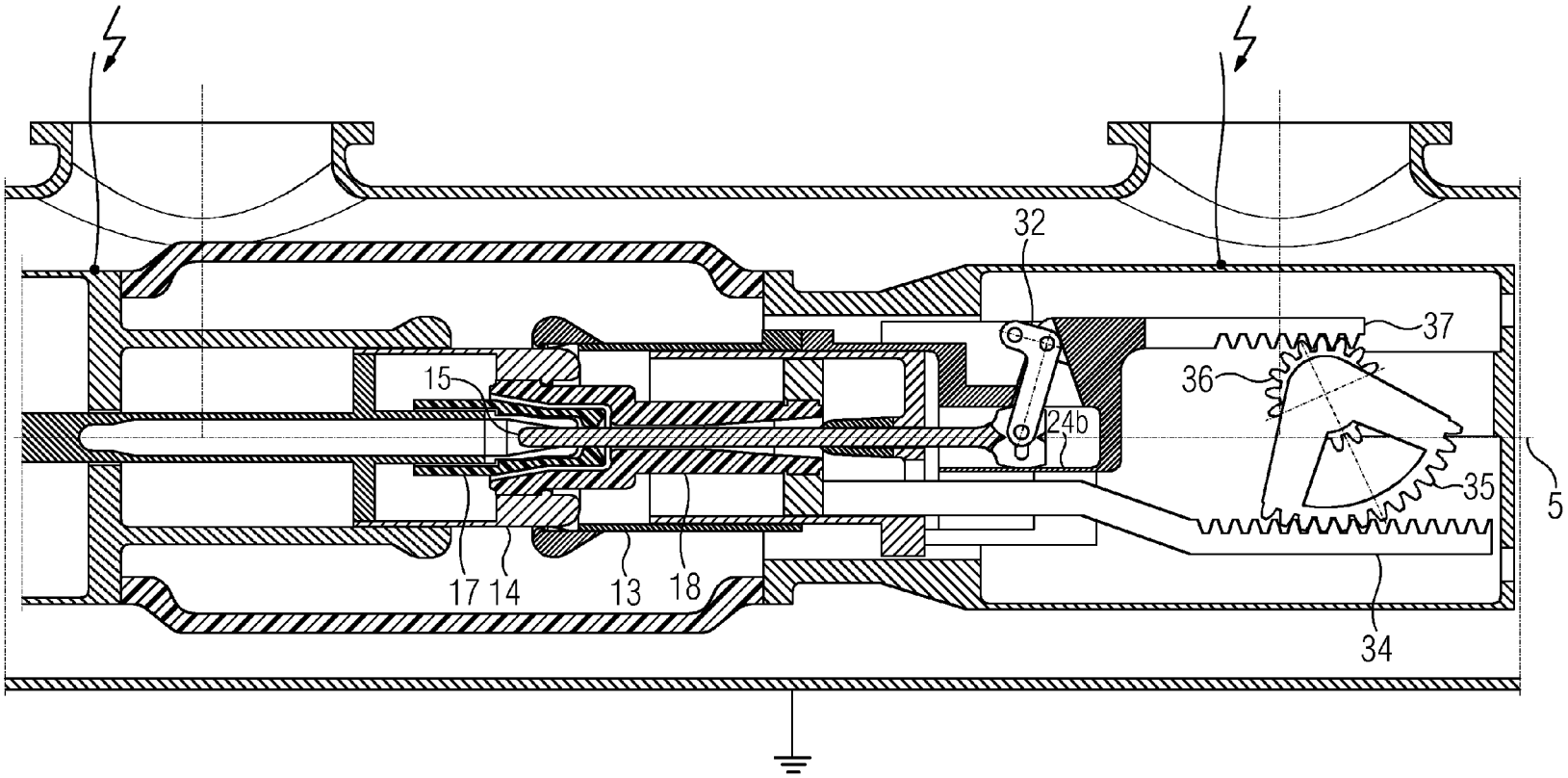

In the second variant an alternative embodiment of an auxiliary console **25*a* and of a sleeve 24*a* is provided. The sleeve 24*a* in accordance with the second variant is equipped with a bearing point, which lies outside the encasement of the sleeve 24*a*. An L-shaped lever 32 is mounted at this bearing point and has a first and a second lever arm. Via its first lever arm, which is longer than the second lever arm, the L-shaped lever is connected to a slot of the hammerhead 29 of the first arcing contact piece 15. In order to positively influence the transmission behavior of the first gearing, the second lever arm, which is shorter than the first lever arm of the L-shaped lever 32, is guided in a slotted guide path 33 of the auxiliary console 25*a*. For this purpose, the second lever arm is equipped with a pin, which protrudes into the slotted guide path 33 of the auxiliary console 25***a*. Here, the slotted glide path 33 is stepped, wherein a gradation occurs transversely to the longitudinal axis 5, such that, at the start of a movement of the first nominal current contact piece 13 (course of movement from FIG. 6 to FIG. 7), there is initially no transmission of an additional movement by the first gearing to the first arcing contact piece 15. As the step is passed, a movement of the first gearing on the stationary counter bearing (here the slotted guide path 33 of the auxiliary console 25*a*) is transmitted to the first arcing contact piece 15. Once the two arcing contact pieces 15, 17 have been contacted, the slotted guide path is formed in such a way that there is no further transmission of a movement via the L-shaped lever 32 of the first gearing. The first arcing contact piece 15 remains still relative to the first nominal current contact piece 13 and is moved together therewith. FIGS. 11 and 12 show a development of the second variant of a switching device arrangement, wherein the first gearing retains the use of an L shaped lever 32 (two-armed lever) and also of the auxiliary console 25*a*, wherein now, however, the embodiment of the second gearing varies. The insulating nozzle 18 is connected at a fixed angle to a first toothed rack 34. The first toothed rack 34 is guided linearly displaceably parallel to the longitudinal axis 5, such that a displacement of the insulating nozzle 18 is accompanied by a displacement of the first toothed rack 34. The linear movement of the first toothed rack 34 is converted into a pivot movement via a first gearwheel 35 of the stationary second gearing. The first gearwheel 35 or the shaft of the first gearwheel 35 is thus a pivot element. In order to transmit the movement, a second gearwheel 36 is provided, which has a reduced diameter compared with the diameter of the first gearwheel 35. The movement delivered from the first toothed rack 34 can thus be transmitted via a rigid coupling of the two gearwheels 35, 36. A second toothed rack 37 couples in a movement, picked up by the second gearwheel 36, at the first nominal current contact piece 13 or at a sleeve 24*b* of the first nominal current contact piece 13. The first and the second toothed rack 35, 37 are each engaged with the respective gearwheel 35, 36 in a diametrically opposed manner, such that the direction of movement of the insulating nozzle 13 or of the second arcing contact piece 17 or of the second nominal current contact piece 14 is reversed via the pivot element of the second gearing. In the third variant according to FIGS. 11 and 12, the L-shaped lever 32 is in turn used at the first gearing. However, the embodiment and use of a pivot element may be provided in an alternative form. By way of example, a fork lever 30, as in the first variant, can also be used in the third variant according to FIGS. 11 and 12.

Figure 13:
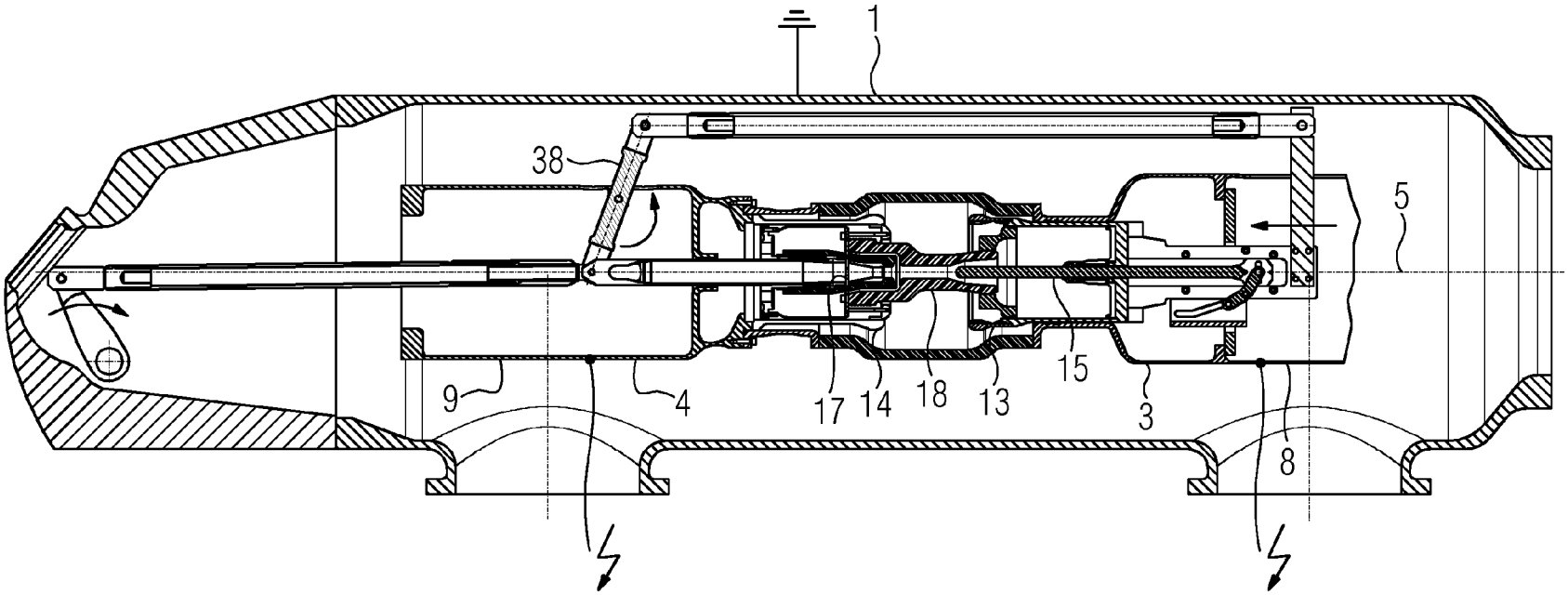
FIGS. 13 to 14 show a fourth variant of a switching device arrangement.
Figure 14:
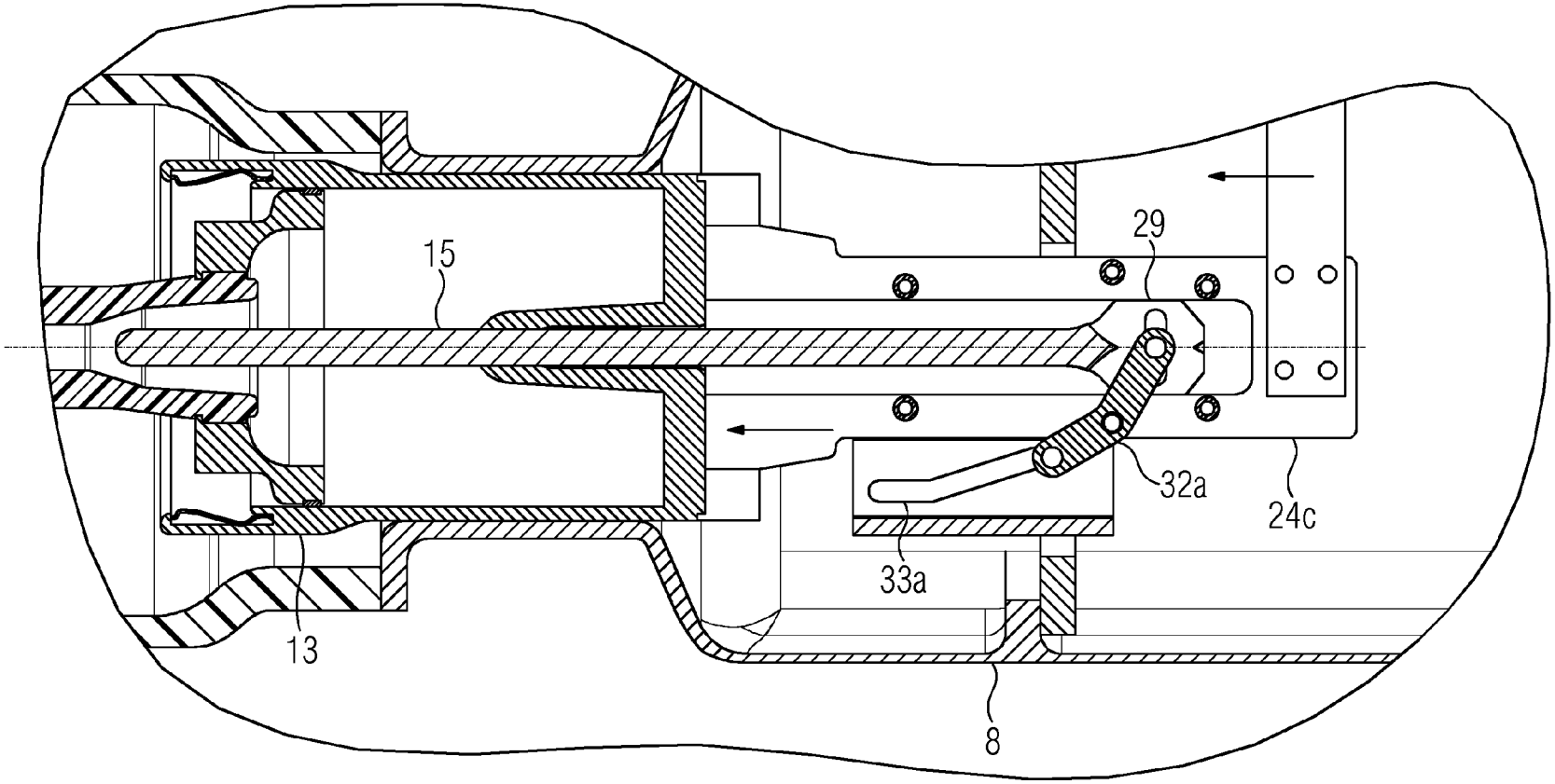

FIG. 13 shows a third variant of a switching device arrangement. By contrast with variants one, two and three according to FIGS. 1 to 12, however, the use of the insulating nozzle 18 as an electrically insulating element in a kinematic chain for driving the first nominal current contact piece 13 or the first arcing contact piece 15 is omitted here. Instead, a movement is already decoupled on the second contact side 4 via a second gearing, which has a pivot element 38, wherein the stationary base (second armature body 9) of the first contact side 3 and of the second contact side 4 (first armature body 8) can be used synonymously. A movement is coupled in at the second nominal current contact piece 14 and the second arcing contact piece 17. A linear movement is converted via the pivot element 38 of the second gearing into a rotary movement from the coupling-in point at the second arcing contact piece 17 and at the second nominal current contact piece 14. Due to the embodiment of the pivot element 38 as a two-armed lever, a movement coupled in at the first lever arm can be decoupled at the second lever arm in the opposite direction. An electrically insulating rod guided parallel to the longitudinal axis 5 and likewise mounted displaceably transmits the movement in parallel beside the interrupter unit within the encapsulating housing 1. The movement is coupled in at the first nominal current contact piece 13 via the electrically insulating rod. The first nominal current contact piece 13 and the rod coupled to the pivot element 38 are connected to one another at a fixed angle, such that the electrically insulating rod and the first nominal current contact piece 13 perform the same movement. The first nominal current contact piece 13 in turn has a sleeve 24*c*, in which the hammerhead 29 of the first arcing contact piece 15 is guided axially displaceably. An L-shaped lever 32*a* is supported rotatably on the sleeve 24*c* of the first nominal current contact piece 13. The L-shaped lever 32*a* is guided slidingly via its first lever arm in a slotted guide path 33*a*. The slotted guide path 33*a* forms a stationary counter bearing for the first gearing. The pivot element in the form of the L-shaped lever 32*a* is guided via its other lever arm in a slot of the hammerhead 29 of the first arcing contact piece 15. A movement of the first nominal current contact piece 13, which is transmitted via the pivot element 38 of the second gearing, leads to a movement of the pivot point of the pivot element 32*a* of the first gearing relative to the stationary counter bearing. The stationary counter bearing in the form of the slotted guide path 33*a* creates an operative connection between the stationary counter bearing and the first gearing. Here, the first armature body 8 can be understood to be a stationary counter bearing, wherein the first armature body 8 and the second armature body 9 are coupled to one another at a fixed angle and thus define the same stationary base. Similarly to the deflection of the L-shaped lever 32 known from variants two and three, the L-shaped lever 32*a* according to the fourth variant is operatively connected to the stationary counter bearing in the form of a slotted guide path 33*a*. The movement of the first nominal current contact piece 13 is superimposed by a movement of the arcing contact piece 15 driven additionally by the first gearing. As can be seen in FIG. 14, the slotted guide path 33*a* is provided at the end of a switching (on) movement with a course running substantially parallel to the longitudinal axis 5, such that there is no further transmission of a movement to the first arcing contact piece 15 in this dead-time element.

Figure 15:
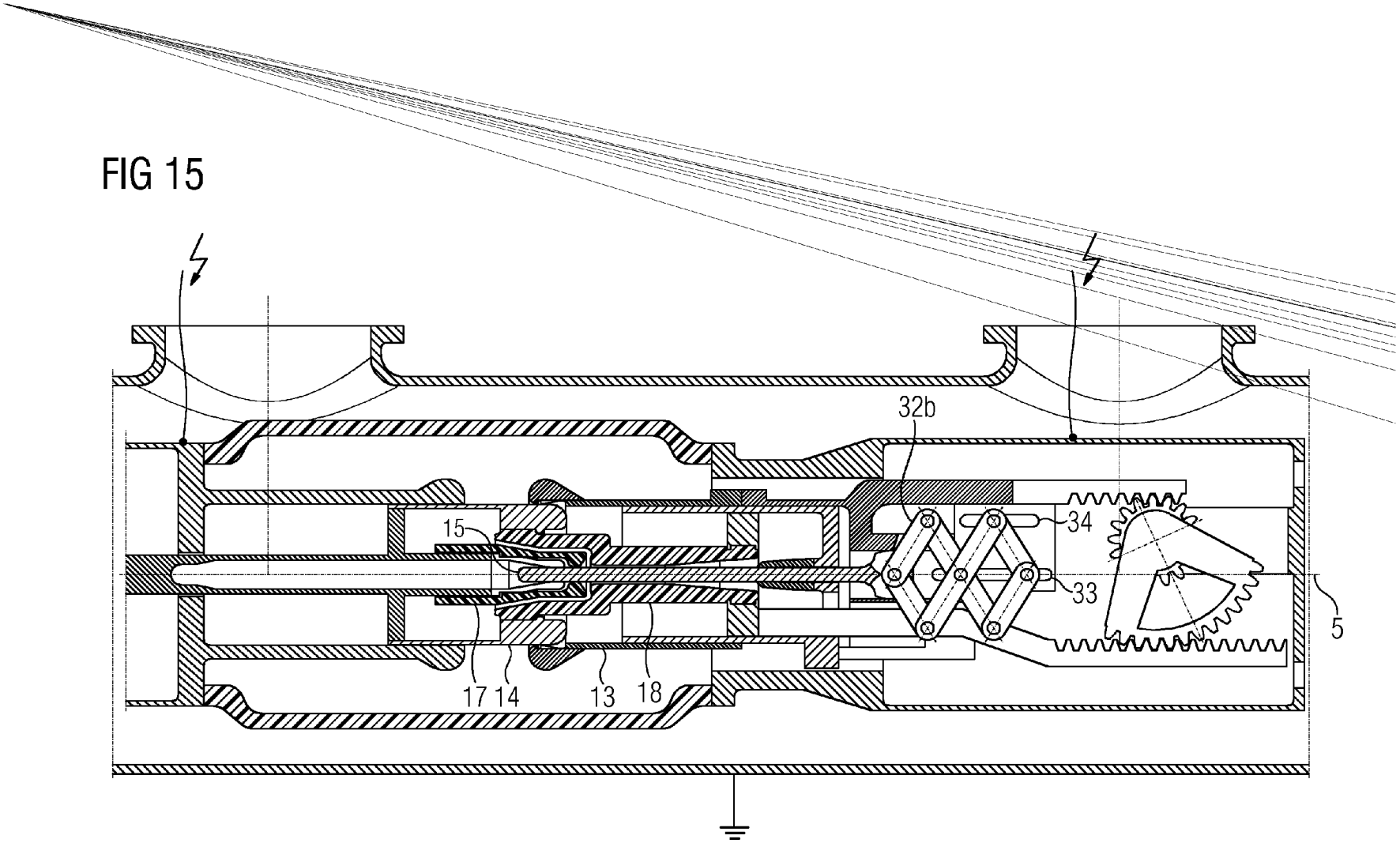
FIGS. 15 to 16 show a fifth variant of a switching device arrangement.
Figure 16:
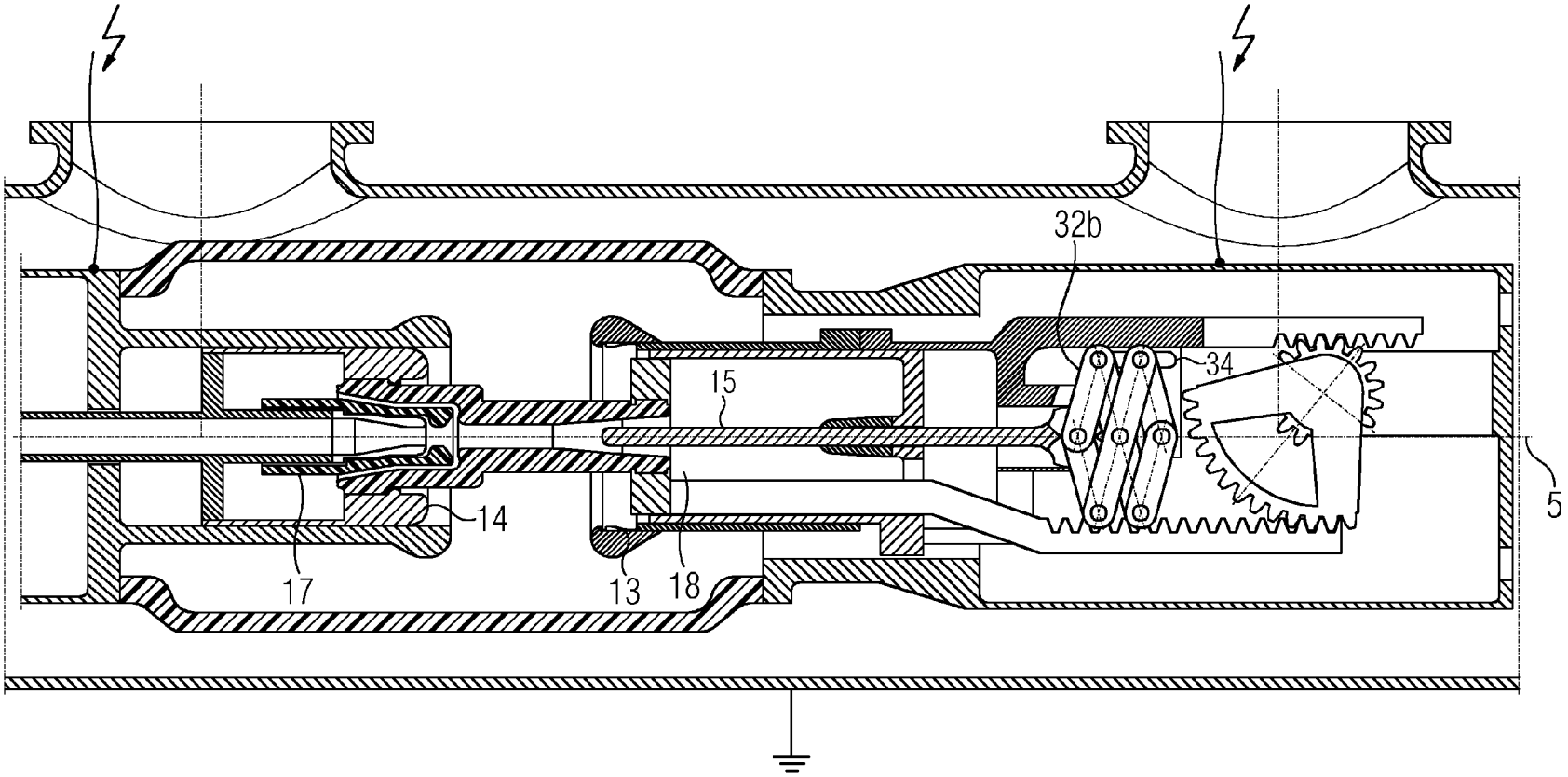

In the fifth variant of a switching device arrangement shown in FIGS. 15 and 16, an alternative to the first gearings known from FIGS. 1, 2, 3, 4, 5, 6, 7, 8, 9, 10, 11, 12, 13 and 14 is used. The fifth variant uses, for the first gearing, a lever arrangement having a two-armed lever 32*b*, which is part of a scissor gear. A scissor gear is a lever arrangement which has a plurality of levers coupled rotatably to one another, which axially displace points of articulation of the levers. The first gearing/the lever arrangement is connected in a stationary manner to the first contact side 3, in particular to the first nominal current contact piece 13. A two-armed lever 32*b* is shown in FIGS. 15 and 16, of which the central pivot point is guided axially displaceably in a slotted guide 33. The slotted guide 33 has a linear form and is oriented parallel to the movement axis of the first arcing contact piece 15. A central scissor of the scissor gear, which comprises the two-armed lever 32*b*, is coupled at the end to further levers, which define the central scissor. The end levers define the central scissor in the manner of toggle mechanisms. Two parallelograms are thus formed adjacently to the central scissor, which comprises the two-armed lever 32*b*, and can vary their inner angle with constant side lengths. Due to be crossed connection of levers within the scissor gear, a linear extension of the scissor gear is made possible. Here, a coupling point between levers of the scissor gear is mounted in a stationary manner/at a fixed angle with the first nominal current contact piece 13. This coupling point should lie on an axis of the linear path of displacement of the scissor gear. The coupling point mounted in a stationary manner is connected in a stationary manner to the first nominal current contact piece 13 of the first contact side 3. A parallelogram-like termination of the scissor gear at the end is positioned in a stationary manner on the first nominal current contact piece at the end on the side facing away from the first arcing contact piece 15. The first arcing contact piece 15 is connected to the scissor gear (to the parallelogram-like termination of the scissor gear facing toward the first arcing contact piece 15). The advantage of a construction of this type is that the first arcing contact piece 15 can be coupled to the scissor gear at a swivel joint since the scissor gear couples in a linear movement at the first arcing contact piece 15. The scissor gear is connected via the levers there in a stationary manner to the first nominal current contact piece 13 or to the first contact side 3. In order to actuate the scissor gear during the course of a movement of the first nominal current contact piece 13, at least one of the scissor elements (two-armed lever 32*b*) is guided in a control slotted guide 34, which is positioned in a stationary manner on an auxiliary console. Here, the auxiliary console remains unmoved, independently of a movement of the nominal current contact pieces 13, 14 and of the arcing contact pieces 15, 17. With a movement of the first contact side 3 or rather of the first nominal current contact piece 13, the scissor gear together with the levers of the scissor gear (due to the stationary mounting thereof in a stationary manner on the first nominal current contact piece 13) is also moved initially with the nominal current contact piece 13. Due to the control slotted guide 34, an extension of the scissor gear is enforced during the course of a switch-on movement, i.e. the first arcing contact piece 15 is moved from a separated position into a contacting position. Conversely, when the arcing contact pieces 15, 17 or the nominal current contact pieces 13, 14 are distanced, the extension of the scissor gear is reversed. Proceeding from the movement (switch-on or switch-off movement) of the first nominal current contact piece 13, an additional movement at increased speed is enforced at the first arcing contact piece 15. The control slotted guide 34 is for this purpose oriented substantially in line with the movement axis of the first arcing contact piece 15 and runs in a manner reducing the distance between the movement axis, at least in portions, dropping in the direction of the movement axis of the first nominal current contact piece 15. A lever 32*a* of the scissor gear travels through the control slotted guide, such that the traveling articulation point is displaced in the control slotted guide 34 transversely to the linear displacement axis of the first arcing contact piece 15 and a pivoting of the lever 32*a* is enforced. Due to the transverse displacement, the scissor gear is extended/contracted, wherein articulation points (scissor articulations) are displaced linearly. Articulation points (outer articulations) on the levers of the scissor gear movable transversely to the longitudinal axis 5 are moved in the axial direction and additionally transversely to the longitudinal axis 5. In FIG. 15 the fifth variant of a switching device arrangement is shown in the switch-on position, i.e. the arcing contact pieces 15, 17 contact one another. The nominal current contact pieces 13, 14 also contact one another. The first gearing, here in the form of a scissor gear, is in an extended position. In a switch-off position according to FIG. 16 the first gearing is in a contracted position, such that the nominal current contact pieces 13, 14 and also the arcing contact pieces 15, 17 are separated from one another. When passing from a switch-on position (FIG. 15) into a switch-off position (FIG. 16), a movement is transmitted via an insulating nozzle 18 to a second gearing. The second gearing corresponds to the second gearing of the third variant illustrated in FIGS. 11 and 12. The second gearing drives the first nominal current contact piece 13. The first gearing mounted in a stationary manner on the first nominal current contact piece 13 is also moved with the first nominal current contact piece 13. By means of a relative movement between the auxiliary console and the control slotted guide 34 located thereon, an extension or contraction of the scissor gear/first gearing is enforced depending on the direction of movement of the first nominal current contact piece 3. The control slotted guide 34 serves here as a stationary counter bearing. The scissor gear/a control element of the first gearing is coupled to the stationary counter bearing.

Similarly to the above exemplary embodiments, it should also be noted here that the first gearing and the second gearing according to the fifth variant can also be used in the further variants 1, 2, 3 and 4, such that different embodiments of the first gearing and also different embodiments of the second gearing can be combined with one another arbitrarily.

The invention claimed is:

1. A switching device arrangement, comprising:

a first contact set and a second contact set, said first contact set being disposed for movement relative to said second contact set in order to produce a switching contact between respective contacts;

said first contact set having an arcing contact piece and a nominal current contact piece movably disposed relative to one another;

a kinematic chain connected to said nominal current contact piece configured to impress a movement onto said nominal current contact piece;

a stationary counter bearing; and a gearing forming an operative connection between said stationary counter bearing and said arcing contact piece, wherein a relative movement is effected between said nominal current contact piece and said arcing contact piece via said gearing;

said stationary counter bearing being coupled to said gearing via a slotted guide path.

2. The switching device arrangement according to claim 1, wherein said stationary counter bearing is configured to control a transmission behavior of said gearing.

3. The switching device arrangement according to claim 1, wherein said gearing is mounted on said first contact set.

4. The switching device arrangement according to claim 3, wherein said gearing is mounted on said nominal current contact piece.

5. The switching device arrangement according to claim 1, wherein said nominal current contact piece is mounted movably in relation to said stationary counter bearing.

6. The switching device arrangement according to claim 1, wherein said gearing includes a control element guided on said stationary counter bearing.

7. The switching device arrangement according to claim 1, wherein the gearing comprises a pivot element pivotally attached to said nominal current contact piece.

8. The switching device arrangement according to claim 1, wherein said gearing comprises a lever arrangement.

9. The switching device arrangement according to claim 1, wherein said gearing is a first gearing and said kinematic chain comprises a second gearing for coupling in a movement at said nominal current contact piece.

10. The switching device arrangement according to claim 9, wherein said second gearing is stationarily mounted.

11. The switching device arrangement according to claim 1, wherein said kinematic chain includes an electrically insulating transmission element.

12. The switching device arrangement according to claim 11, wherein said electrically insulating transmission element is an insulating nozzle protruding into a clearance between the contacts.

13. The switching device arrangement according to claim 1, which comprises a common drive apparatus commonly driving said first and second contact sets.

14. The switching device arrangement according to claim 1, wherein said gearing is a first gearing and said kinematic chain includes a second gearing, and wherein said first gearing and said second gearing are arranged in succession in a direction of a flow of force.

15. The switching device arrangement according to claim 14, wherein said second gearing includes a stationarily mounted rotation element.

16. The switching device arrangement according to claim 15, wherein said rotation element is a gearwheel.

17. The switching device arrangement according to claim 15, wherein said rotation element is a pivot lever.

18. The switching device arrangement according to claim 14, wherein one of said first and second gearings is configured to convert a driving movement into an oppositely directed driven movement and a respectively other gearing is configured to amplify the oppositely directed movement.

19. The switching device arrangement according to claim 14, wherein said second gearing converts the driving movement into the oppositely directed driven movement and said first gearing amplifies the oppositely directed movement.

* * * * *